US006816142B2

(12) United States Patent
Oda et al.

(10) Patent No.: US 6,816,142 B2
(45) Date of Patent: Nov. 9, 2004

(54) LIQUID CRYSTAL DISPLAY DEVICE

(75) Inventors: Kyoichiro Oda, Tokyo (JP); Akimasa Yuuki, Tokyo (JP); Shin Tahata, Tokyo (JP); Toshio Tobita, Tokyo (JP); Shiro Miyake, Kumamoto (JP); Kazuhiro Kobayashi, Kumamoto (JP); Keiichi Murayama, Kumamoto (JP)

(73) Assignees: Mitsubishi Denki Kabushiki Kaisha, Tokyo (JP); Advanced Display Inc., Kumamoto (JP)

( * ) Notice: Subject to any disclaimer, the term of this patent is extended or adjusted under 35 U.S.C. 154(b) by 339 days.

(21) Appl. No.: 09/986,902

(22) Filed: Nov. 13, 2001

(65) Prior Publication Data

US 2002/0057241 A1 May 16, 2002

(30) Foreign Application Priority Data

Nov. 13, 2000 (JP) ..... 2000-345293
Oct. 15, 2001 (JP) ..... 2001-316722

(51) Int. Cl.[7] ..... G09G 3/36
(52) U.S. Cl. ..... 345/89; 345/103
(58) Field of Search ..... 345/92, 102, 103, 345/204, 87, 90, 98, 100

(56) References Cited

U.S. PATENT DOCUMENTS 5,731,794 A * 3/1998 Miyazawa ..... 345/88
5,841,415 A * 11/1998 Kwon et al. ..... 345/90
6,392,620 B1 * 5/2002 Mizutani et al. ..... 345/88
6,452,582 B1 * 9/2002 Rolston ..... 345/102
6,535,191 B1 * 3/2003 Miyachi ..... 345/94
6,570,554 B1 * 5/2003 Makino et al. ..... 345/102
6,611,249 B1 * 8/2003 Evanicky et al. ..... 345/102
2002/0000960 A1 * 1/2002 Yoshihara et al. ..... 345/87

FOREIGN PATENT DOCUMENTS

JP 11-202285 7/1999

* cited by examiner

*Primary Examiner*—Henry N. Tran
(74) *Attorney, Agent, or Firm*—Leydig, Voit & Mayer, Ltd.

(57) ABSTRACT

A liquid crystal display device comprising a signal correcting means for correcting a level of an original image signal to a level with which transmittance in a steady state of the pixel with the original image signal is attained within one frame period, a horizontal driving means for applying a voltage in correspondence with the corrected image signal to liquid crystal, and an illumination device for illuminating the display panel with a plurality of light emitting regions thereof, said light emitting regions sequentially turns on and off in synchronization with the application of the corrected image signal while holding a definite time delay thereto.

19 Claims, 24 Drawing Sheets

FIG. 5

32a

| GRADATIONS / GRADATIONS | | CURRENT FRAME IMAGE SIGNAL id | | | | |
|---|---|---|---|---|---|---|
| | | 0 | 1 | 2 | ——— | 255 |
| PREVIOUS FRAME IMAGE SIGNAL jd | 0 | | | | | |
| | 1 | | | | | |
| | 2 | | | | | |
| | ——— | | | | OUTPUT DATA od(jd, id) | |
| | 255 | | | | | |

FIG. 6

32a

| GRADATIONS \ GRADATIONS | | CURRENT FRAME IMAGE SIGNAL c(id) | | | | |
|---|---|---|---|---|---|---|
| | | 0 | 1 | 2 | ——·——·—— | 7 |
| PREVIOUS FRAME IMAGE SIGNAL c(jd) | 0 | | | | | |
| | 1 | | | | | |
| | 2 | | | | | |
| | ——·—— | | | | OUTPUT DATA od[c(jd), c(id)] | |
| | 7 | | | | | |

FIG. 8

32b

| GRADATIONS \ GRADATIONS | | CURRENT FRAME IMAGE SIGNAL c(id) | | | | |
|---|---|---|---|---|---|---|
| | | 0 | 1 | 2 | — — — | 7 |
| PREVIOUS FRAME IMAGE SIGNAL c(jd) | 0 | | | | | |
| | 1 | | | | | |
| | 2 | | | | | |
| | — — — | | | | INTERPOLATION DEFFERENTIAL DATA $\Delta od[c(jd), c(id)]$ | |
| | 7 | | | | | |

LIQUID CRYSTAL DISPLAY DEVICE

BACKGROUND OF THE INVENTION

The present invention relates to liquid crystal display devices, and, more particularly, to a liquid crystal display device having a drive means for applying a voltage to each pixel of a liquid crystal display device, and an illumination light source.

The liquid crystal display device (hereinafter referred to as an LCD) produces a highly precise display and has characteristics such as a low consumed power, reduced volume for the display device, or the like. It is expected that liquid crystal display devices will entirely replace a cathode ray tube (hereinafter referred to as a CRT) in various usages, such as a computer monitor, a television display device, or the like. However, since the LCD does not have sufficient image quality in displaying a moving picture as compared with the CRT, improvement in the quality of the moving picture is desired. In particular, it is required that the moving picture can be displayed with a high image quality on the basis of the current television signal at the time of the application of the LCD to a television display device.

It is assumed that problems in the moving picture display of the LCD lie in the following points. In the beginning, in the case where a screen is displayed which shows a white object 50 moving against a black background in a direction of an arrow as shown in FIG. 20(*a*), an "object blur" is generated in which a contour of an object 50 can be perceived in a blurred manner by an observer as shown in FIG. 20(*b*). In addition, a "ghost" is also generated in which a residual image 51 of the object 50 before the movement can be perceived as shown in FIG. 20(*c*).

One problem in such a moving picture display results from a long response time of the liquid crystal with respect to the signal. In the LCD of the twisted nematic type (hereinafter referred to as a TN type) and the super twisted nematic type (hereinafter referred to as a STN type) which are currently generally used, electro-optic response of the liquid crystal is relatively slow so that it takes a long time from the application of an electric field to the attainment of a desired light transmittance with the electrically changed arrangement of the liquid crystal molecule and is several times longer than 16.7 msec, which is a display cycle of one screen (hereinafter referred to as one frame) in a ordinary image signal. Consequently, as shown in FIG. 21, even when a voltage for a white display is applied to a liquid crystal which is providing a black display, a relatively long time is required until the liquid crystal attains a completely white state. Thus, an optical response of the liquid crystal at the moving potion is not completed in one frame period. A delay in the optical response of this liquid crystal is visually recognized as a motion blur and a ghost.

Furthermore, it is considered that the fact that displaying in the LCD is of a hold type, in which light emission of same amount continues until the LCD is rewritten by image signal of the next frame, results in a low display image quality with respect to the moving picture. In a thin film transistor type (hereinafter referred to as the TFT type) LCD which is mainstream among LCDs, electric charge for applying electric field to the liquid crystal can be held at a relatively high ratio until the electric field is subsequently applied. Consequently, as shown in FIG. 22(*a*), each of the pixels of the LCD continuously transmits light until the pixel is rewritten with the application of the electric field on the basis of the image signal of the next frame. On the other hand, in the CRT display device which provides a display by scanning a screen with an electron beam to allow fluorescent material on the screen to emit light, as shown in FIG. 22(*b*), light emission of each pixel is an impulse-like manner. Consequently, the LCD has a low time frequency characteristic of the image display light as compared with the CRT, so that the spatial frequency characteristic is lowered along with this to provide a blur in a visually observed image.

There is disclosed, for example, in the Japanese Unexamined Patent Publication No. 11-202285 an example in which a backlight is equipped with plurality of lamps and the lamps are sequentially driven in order to improve the image quality in the display of the moving picture of the LCD. FIG. 23 is a block diagram showing a structure of such liquid crystal display device. A backlight 54 arranged on a rear surface of the liquid crystal panel is divided into a plurality of light emission regions 54*a* through 54*d*, so that a lamp 56 in each of the light emission regions 54*a* through 54*d* is allowed to be subsequently emitted with a lighting control circuit 60 while holding a definite time delay with respect to the operation of writing an image to the liquid crystal in a corresponding region.

FIG. 24 is a timing chart showing a relation between an optical response of the liquid crystal and the backlight emission in such liquid crystal display device. In FIG. 24, a signal for each pixel, an optical response of the liquid crystal in each pixel, and turn ON/OFF timing of the lamps in the backlight are shown.

In the beginning, at the previous frame, transmittance 64 of the pixel in the n-th row is rewritten from black, i.e., lower transmittance, to white, i.e., higher transmittance, by applying a voltage corresponding to a white signal. Immediately after rewriting, the transmittance 64 of the pixel increases rapidly and then increases gradually toward a truly white display, taking the time of several frames. In the subsequent frame, transmittance 65 of a pixel in the (n+I)-th row is rewritten from black to white with the same behavior as the pixel in n-th row in a delay of one frame period (about 16 msec).

At the same time, the backlight is lit only in a predetermined period after the lapse of a definite time from the rewriting of the image signal in each frame period as shown in the lower part of FIG. 24. As a consequence, the halfway transition in the transmittance of the liquid crystal is not apparent to observers so that the image quality in displaying the moving picture is improved. Furthermore, the transmitted light of each pixel comes close to the impulse-like manner, so that the image quality in the moving picture display is improved.

However, in the conventional liquid crystal display which has been explained above, the motion blur is suppressed but the "ghost" cannot be sufficiently erased. As shown in FIG. 20(*c*), the "ghost" appears as a difference in contrast between the region 52 which is rewritten from the black image to the white image and the region 53 which is rewritten from the white image to the white image. That is, since response of the liquid crystal is relatively slow, the region 52 recently rewritten to white is darker than the region 53 anciently rewritten to white. Although illumination by the backlight is limited to the end of each frame period, transmittance 64 of the liquid crystal in the region 52 which is rewritten from black to white and transmittance 66 of the liquid crystal in the region 53 which is rewritten from white to white are different even in this illuminating period as shown in FIG. 24 because response time of the general TN-type liquid crystal is several times longer than the frame period. This luminance difference completely disappears several frames after the rewriting of image. Consequently, the "ghost" remains even when the lighting period of the backlight is restricted to the shortest possible level.

Furthermore, as has been already explained in FIG. 21, the response of the liquid crystal is relatively slow, so that several frame periods are required until the approximate completion of the response. For all this, in the conventional liquid crystal display device, a voltage is applied to the liquid crystal which produces a desired transmittance in the state in which a sufficient time passes and the response of the liquid crystal is approximately completed. As a consequence, the transmittance of the liquid crystal does not attain a desired transmittance during the current frame, so that the display quality of the moving picture is deteriorated.

SUMMARY OF THE INVENTION

Therefore, the present invention provides a liquid crystal display device which can eliminate the "ghost" even when using the TN-type liquid crystal having a slow response rate and which can obtain a favorable display quality of the moving picture by compensating for the slow response of the liquid crystal.

Furthermore, an object of the present invention is to provide a liquid crystal display device which has a high response rate of the liquid crystal and an excellent display performance of the moving picture without remarkably increasing the required amount of the memory and the scale of the circuit.

In order to solve the above problem, a liquid crystal display device according to one aspect of the present invention comprises:

a display panel having pixels arranged in a matrix-like rows and columns configuration and switching means connected to each of the pixels;

a vertical driving circuit for scanning the whole display area of the display panel over one frame period by selecting the rows of pixels alternately while turning on the switching means connected thereto; and a horizontal driving means for applying voltage, which corresponds to an image signal, to each pixel in said selected row through the switching means being turned on;

wherein a signal correcting means, for correcting a level of an original image signal to a level with which transmittance in a steady state of the pixel with the original image signal is attained within one frame period and providing the corrected image signal to the horizontal driving means, is provided, and wherein an illumination device for illuminating the display panel with a plurality of light emitting regions thereof, said light emitting regions sequentially turns on and off in synchronization with the selection of rows belonging to each region while holding a definite time delay to the selection of rows, is provided.

Furthermore, the liquid crystal display device according to another aspect of the present invention comprises:

a display panel having pixels arranged in a matrix-like rows and columns configuration and switching means connected to each of the pixels;

a vertical driving circuit for scanning the whole display area of the display panel over one frame period by selecting the rows of pixels alternately while turning on the switching means connected thereto; and a horizontal driving means for applying voltage, which corresponds to an image signal, to each pixel in said selected row through the switching means being turned on;

wherein a signal correcting means, for correcting a level of an original image signal to a level with which transmittance in a steady state of the pixel with the original image signal is attained within one frame, is provided, wherein an election means, for selectively providing the corrected image signal or an erasure signal to the horizontal driving means in a manner that the corrected image signals are provided for the pixels in even number rows while the erasure signal is provided for the pixels in odd number rows at even number frames and the erasure signal is provided for the pixels in even number rows while the corrected image signals are provided for the pixels in odd number rows at odd number frames, is provided, and wherein an illumination device for illuminating the display panel with a plurality of light emitting regions thereof, said light emitting regions sequentially turns on and off in synchronization with the selection of rows belonging to each region while holding a definite time delay to the selection of rows, is provided.

Furthermore, the liquid crystal display device according to another aspect of the present invention comprises:

a display panel having pixels arranged in a matrix-like rows and columns configuration and switching means connected to each of the pixels;

a vertical driving circuit for scanning the whole display area of the display panel over one frame period by selecting the rows of pixels alternately while turning on the switching means connected thereto; and a horizontal driving means for applying voltage, which corresponds to an image signal, to each pixel in said selected row through the switching means being turned on;

wherein a temperature detecting means for detecting temperature of liquid crystal in the display panel is provided, wherein a signal correcting means, for correcting a level of an original image signal to a level with which transmittance in a steady state of the pixel with the original image signal is attained within one frame period using said detected temperature as a parameter and providing the corrected image signal to the horizontal driving means, is provided, and wherein an illumination device for illuminating the display panel with a plurality of light emitting regions thereof, said light emitting regions sequentially turns on and off in synchronization with the selection of rows belonging to each region while holding a definite time delay to the selection of rows, is provided.

Furthermore, the liquid crystal display device according to another aspect of the present invention comprises:

a display panel having pixels arranged in a matrix-like rows and columns configuration and switching means connected to each of the pixels;

a vertical driving circuit for scanning the whole display area of the display panel over one frame period by selecting the rows of pixels alternately while turning on the switching means connected thereto; and a horizontal driving means for applying voltage, which corresponds to an image signal, to each pixel in said selected row through the switching means being turned on;

wherein a temperature detecting means for detecting temperature of liquid crystal in the display panel is provided, wherein a signal correcting means, for correcting a level of an original image signal to a level with which transmittance in a steady state of the pixel with the original image signal is attained within one frame period using said detected temperature as a parameter, is provided, wherein an election means, for selectively providing the corrected image signal or an erasure signal to the horizontal driving means in a manner that the corrected image signals are provided for the pixels in even number rows while the erasure signal is provided for the pixels in odd number rows at even number frames and the erasure signal is provided for the pixels in even number rows while the corrected image signals are provided for the pixels in odd number rows at odd number frames, is provided, and wherein an illumination device for illuminating the display panel with a plurality of light emitting regions thereof, said light emitting regions sequentially turns on and off in synchronization with the selection of rows belonging to each region while holding a definite time delay to the selection of rows, is provided.

Furthermore, the liquid crystal display device according to another aspect of the present invention comprises:

a display panel having pixels arranged in a matrix-like rows and columns configuration and switching means connected to each of the pixels;

a vertical driving circuit for scanning the whole display area of the display panel over one frame period by selecting the rows of pixels alternately while turning on the switching means connected thereto; and a horizontal driving means for applying voltage, which corresponds to an image signal, to each pixel in said selected row through the switching means being turned on;

wherein a signal correcting means, for correcting a level of an original image signal to a level with which transmittance in a steady state of the pixel with the original image signal is attained within one frame period and providing the corrected image signal to the horizontal driving means, is provided, and wherein an illumination device for illuminating the display panel with a plurality of light emitting regions thereof, said light emitting regions sequentially turns on and off in synchronization with the selection of rows belonging to each region while holding a definite time delay to the selection of rows, and current flowing through a lamp in each light emitting region is independently controlled with each other, is provided.

Furthermore, the liquid crystal display device according to another aspect of the present invention comprises:

a display panel having pixels arranged in a matrix-like rows and columns configuration and switching means connected to each of the pixels;

a vertical driving circuit for scanning the whole display area of the display panel over one frame period by selecting the rows of pixels alternately while turning on the switching means connected thereto; and a horizontal driving means for applying voltage, which corresponds to an image signal, to each pixel in said selected row through the switching means being turned on;

wherein a signal correcting means, for correcting a level of an original image signal to a level with which transmittance in a steady state of the pixel with the original image signal is attained within one frame period and providing the corrected image signal to the horizontal driving means, is provided, and wherein an illumination device for illuminating the display panel with a plurality of light emitting regions thereof, said light emitting regions sequentially turns on and off in synchronization with the selection of rows belonging to each region while holding a definite time delay to the selection of rows, and turn on period of each light emitting region is independently controlled with each other, is provided.

Furthermore, the liquid crystal display device according to another aspect of the present invention comprises:

a display panel having pixels arranged in a matrix-like rows and columns configuration and switching means connected to each of the pixels;

a vertical driving circuit for scanning the whole display area of the display panel over one frame period by selecting the rows of pixels alternately while turning on the switching means connected thereto; and a horizontal driving means for applying voltage, which corresponds to an image signal, to each pixel in said selected row through the switching means being turned on;

wherein a signal correcting means, for correcting a level of an original image signal to a level with which transmittance in a steady state of the pixel with the original image signal is attained within one frame period and providing the corrected image signal to the horizontal driving means, is provided, and wherein an illumination device for illuminating the display panel with a plurality of light emitting regions thereof, said light emitting regions sequentially turns on and off in synchronization with the selection of rows belonging to each region while holding a definite time delay to the selection of rows, and turn on period of each light emitting region is further divided into turn on sub-periods and turn off sub-periods, is provided.

It is preferable that a ratio of the turn on sub-periods to the turn on period for each light emitting region is independently controlled with each other.

Furthermore, the above liquid crystal display device according to the present invention is characterized in that the erasure signal is either an image signal of black level or an image signal of intermediate gray level.

Furthermore, a liquid crystal display device according to another aspect of the present invention is characterized in that an image signal of current frame is externally input, a voltage with which transmittance designated by said current frame image data is attained within one frame period is applied to liquid crystal at the current frame, and said voltage applied to the liquid crystal varies in accordance with temperature of liquid crystal.

Furthermore, a liquid crystal display device according to another aspect of the present invention is characterized in that a voltage with which transmittance designated by a current frame image data is attained within one frame period is determined depending on the current frame image data and a previous frame image data and applied to liquid crystal at the current frame, and said voltage applied to the liquid crystal varies in accordance with temperature of liquid crystal.

Furthermore, the liquid crystal display device according to another aspect of the present invention comprises:

a temperature detection circuit for detecting a temperature of a liquid crystal;

a frame memory for storing a present frame image signal for a definite time to output as a previous frame image signal;

a plurality of signal conversion tables in which output data is stored in correspondence to the each value of the previous frame image signal and each value of the current frame image signal; and a processor for determining the output data from the current frame image signal and the previous frame image signal by using one of the signal conversion table selected on the basis of the detected temperature of the temperature detection circuit.

Furthermore, the liquid crystal display device according to another aspect of the present invention comprises:

a temperature detection circuit for detecting a temperature of a liquid crystal;

a frame memory for storing a present frame image signal for a definite time to output as a previous frame image signal;

a plurality of signal conversion tables in which output data is stored in correspondence to some of each value of the previous frame image signal and some of each value of the current frame image signal; and a processor for determining the output data from the current frame image signal and the previous frame image signal by using one of the signal conversion table selected on the basis of the detected temperature of the temperature detection circuit.

Furthermore, the liquid crystal display device according to another aspect of the present invention comprises:

a temperature detection circuit for detecting a temperature of a liquid crystal;

a converting means for converting a bit length of the current frame image signal;

a frame memory for storing a present frame image signal, having bit length thereof converted, for a definite time to output as a previous frame image signal;

a plurality of signal conversion tables in which output data is stored in correspondence to some of each value of the previous frame image signal and some of each value of the current frame image signal; and a processor for determining the output data from the current frame image signal and the previous frame image signal by using one of the signal conversion table selected on the basis of the detected temperature of the temperature detection circuit.

Furthermore, the liquid crystal display device according to another aspect of the present invention comprises:

a temperature detection circuit for detecting a temperature of a liquid crystal;

a frame memory for storing a present frame image signal for a definite time to output as a previous frame image signal;

a plurality of signal conversion tables in which output data is stored in correspondence to some of each value of the previous frame image signal and some of each value of the current frame image signal;

a signal conversion interpolation table in which interpolation differential data is stored in correspondence to some of each value of the previous frame image signal and some of each value of the current frame image signal; and a processor for determining the output data from the current frame image signal and the previous frame image signal by using one of the signal conversion table selected on the basis of the detected temperature of the temperature detection circuit and the signal conversion interpolation table.

Furthermore, a liquid crystal display device according to another aspect of the present invention comprises:

a temperature detection circuit for detecting a temperature of a liquid crystal;

a converting means for converting a bit length of the current frame image signal;

a frame memory for storing a present frame image signal, having bit length thereof converted, for a definite time to output as a previous frame image signal;

a plurality of signal conversion tables in which output data is stored in correspondence to some of each value of the previous frame image signal and some of each value of the current frame image signal;

a signal conversion interpolation table in which interpolation differential data is stored in correspondence to some of each value of the previous frame image signal and some of each value of the current frame image signal; and a processor for determining the output data from the current frame image signal and the previous frame image signal by using one of the signal conversion table selected on the basis of the detected temperature of the temperature detection circuit and the signal conversion interpolation table.

Furthermore, the liquid crystal display device according to another aspect of the present invention comprises:

a converting means for converting a bit length of the current frame image signal;

a frame memory for storing a present frame image signal, having bit length thereof converted, for a definite time to output as a previous frame image signal;

a signal conversion table in which output data is stored in correspondence to some of each value of the previous frame image signal and some of each value of the current frame image signal;

a processor for determining the output data from the current frame image signal and the previous frame image signal by using the signal conversion table; and an illumination device for illuminating the display area of the liquid crystal display with a plurality of horizontal stripe light emitting regions thereof separately.

Furthermore, the liquid crystal display device according to another aspect of the present invention comprises:

a temperature detection circuit for detecting a temperature of liquid crystal;

a converting means for converting a bit length of the current frame image signal;

a frame memory for storing a present frame image signal, having bit length thereof converted, for a definite time to output as a previous frame image signal;

a plurality of signal conversion tables in which output data is stored in correspondence to some of each value of the previous frame image signal and some of each value of the current frame image signal;

a processor for determining the output data from the current frame image signal and the previous frame image signal by using one of the signal conversion tables selected on the basis of the detected temperature of the temperature detection circuit; and an illumination device for illuminating the display area of the liquid crystal display with a plurality of horizontal stripe light emitting regions thereof separately.

Furthermore, in the above liquid crystal display device according to the present invention, the number of gradations represented by the previous frame image signal having bit length thereof converted is preferably equal to the number of gradations of the previous frame image signal in the signal conversion table.

Furthermore, in the liquid crystal display device according to the present invention, the output data in the signal conversion table is previously determined preferably in a manner that a transmittance designated by the current frame image signal is attained within one frame period by applying a voltage determined by the output data.

Furthermore, another aspect of the present invention relates to a liquid crystal display device of an active matrix type for displaying an image signal of interlaced type comprising even number fields and odd number fields, wherein original image signal designating a image to be displayed is corrected so as to enlarge a level difference between the original image signal and an erasure signal, and corrected image signals are provided for the pixels in even number rows while a erasure signal is provided for the pixels in odd number rows at even number fields and the erasure signal is provided for the pixels in even number rows while corrected image signals are provided for the pixels in odd number rows at odd number fields.

Since the image displayed in the previous field is erased by writing the erasure signal before writing the image signal, the allowed time for optical response of each pixel can be uniformed irrespective of the display image of the previous frame. For example, in the case where the pixel for providing the black display and the pixel for providing the white display in the previous frame are rewritten in a new gradation level in the same frame, any of the pixels is uniformed in the same erasure signal in the even number field and the odd number field, followed by being rewritten in the gradation signal in the next field. Consequently, a luminance difference between pixels resulting from the difference in the response of the liquid crystal can be virtually eliminated. Consequently, the "ghost" can be erased.

In order to conduct the above operation, the liquid crystal display device according to another aspect of the present invention comprises:

a display panel having pixels arranged in a matrix-like rows and columns configuration and having switching means connected to each of the pixels;

a row driving circuit for scanning the whole display area of the display panel by selecting rows of pixels while turning on the switching means connected thereto; and a column driving circuit for writing signal into the pixel of the selected row in synchronization with the selection of rows;

wherein the row driving circuit subsequently selects all the rows over one field period, the column driving circuit outputs a corrected image signal when the even number row is selected and outputs an erasure signal when the odd number row is selected at the even number field, the column driving circuit outputs a corrected image signal when the odd number row is selected and outputs the erasure signal when the even number row is selected at the odd number field.

That is, this liquid crystal display device writes an erasure signal by outputting an interlaced type image signal and the erasure signal alternately to the source signal line in synchronization with selection of row. Therefore, the erasure signal can be written without largely changing the circuit structure of the conventional liquid crystal display device of the active matrix type for displaying progressive image signal.

In order to alternately output the interlaced type image signal and the erasure signal, for example, the column driving circuit is connected to the supply source of the image signal and the supply source of the erasure signal in a switchable manner, so that the connection to the supply source of the image signal and the supply source of the erasure signal may be alternately changed over for in synchronization with the row selection by the row driving circuit.

Preferably, the erasure signal to be written into each pixel is an image signal of black. In the case of a TN type liquid crystal display device of normally white mode, the response speed of the liquid crystal becomes faster in the change from white to black than in the change from black to white. The state of the liquid crystal is stabilized faster at the time of writing the erasure signal of black with an increase in the response speed of the liquid crystal.

Furthermore, the response speed of the liquid crystal is accelerated by correcting the image signal, which is applied after writing of the black erasure signal, to a corrected image signal which is enhanced in a direction of rendering the signal brighter than the original image signal. Thus, the deterioration in the screen luminance resulting from the writing of the erasure signal can be suppressed.

Furthermore, in order to further improve the display quality of the moving picture, the liquid crystal display device of the active matrix type of the present invention comprises a light source which is provided on a backside of the display panel and illuminates the display panel with dividing the display panel into a plurality of horizontal stripe display regions; and wherein the light source illuminates the display region only for a predetermined period which is delayed from the completion of the scanning of each display region in each of the even number field and the odd number field.

Before writing the image signal, the potential of all the pixels are adjusted to the potential of the erasure signal. Since illumination is provided only in a period in which the response of the liquid crystal after writing the image signal is mostly settled, with the result that the ghost is further suppressed. Furthermore, since the illumination period is restricted to some extent, an impulse type light emission is provided so that a sharp image free from the motion blur can be provided.

In order to provide illumination divided into a plurality of display regions, a light source having a plurality of lamps which is divided for each display region and can be lighted independently can be used.

Furthermore, instead of this, a light source may be used which comprises a shutter which is divided for each display region and can be opened and closed.

As has been described above, the liquid crystal display device according to the present invention is characterized in that a voltage, with which transmittance in a steady state of the pixel with the original image signal is attained within one frame period, is determined based on the original current frame image signal and provided to liquid crystal at the current frame.

Furthermore, the liquid crystal display device according to the present invention is characterized in that a light source is provided which is capable of illuminating by dividing the display panel into regions to illuminate the region after a definite delay period after the completion of the scanning of each of the regions.

Furthermore, the liquid crystal display device according to the present invention is characterized in that a temperature of the liquid crystal in the liquid crystal display device is detected at the time of determining a voltage applied to the liquid crystal with respect to the input image signal, and a voltage is applied which is required for realizing a target transmittance after one frame in accordance with the detected temperature.

Furthermore, the liquid crystal display device according to the present invention is characterized in that a row which is originally non-selected is also scanned in each field to write an erasing signal to each pixel of the row in the case where an interlaced type image signal is displayed.

BRIEF DESCRIPTION OF THE DRAWINGS

FIG. 5 is a view showing an example of a signal conversion table in the liquid crystal display device according to the present invention;

FIG. 6 is a view showing an example of a signal conversion table in the liquid crystal display device according to the present invention;

FIG. 8 is a view showing an example of a signal conversion interpolation table in the liquid crystal display device;

DETAILED DESCRIPTION OF THE INVENTION

Embodiment 1

Figure 1:
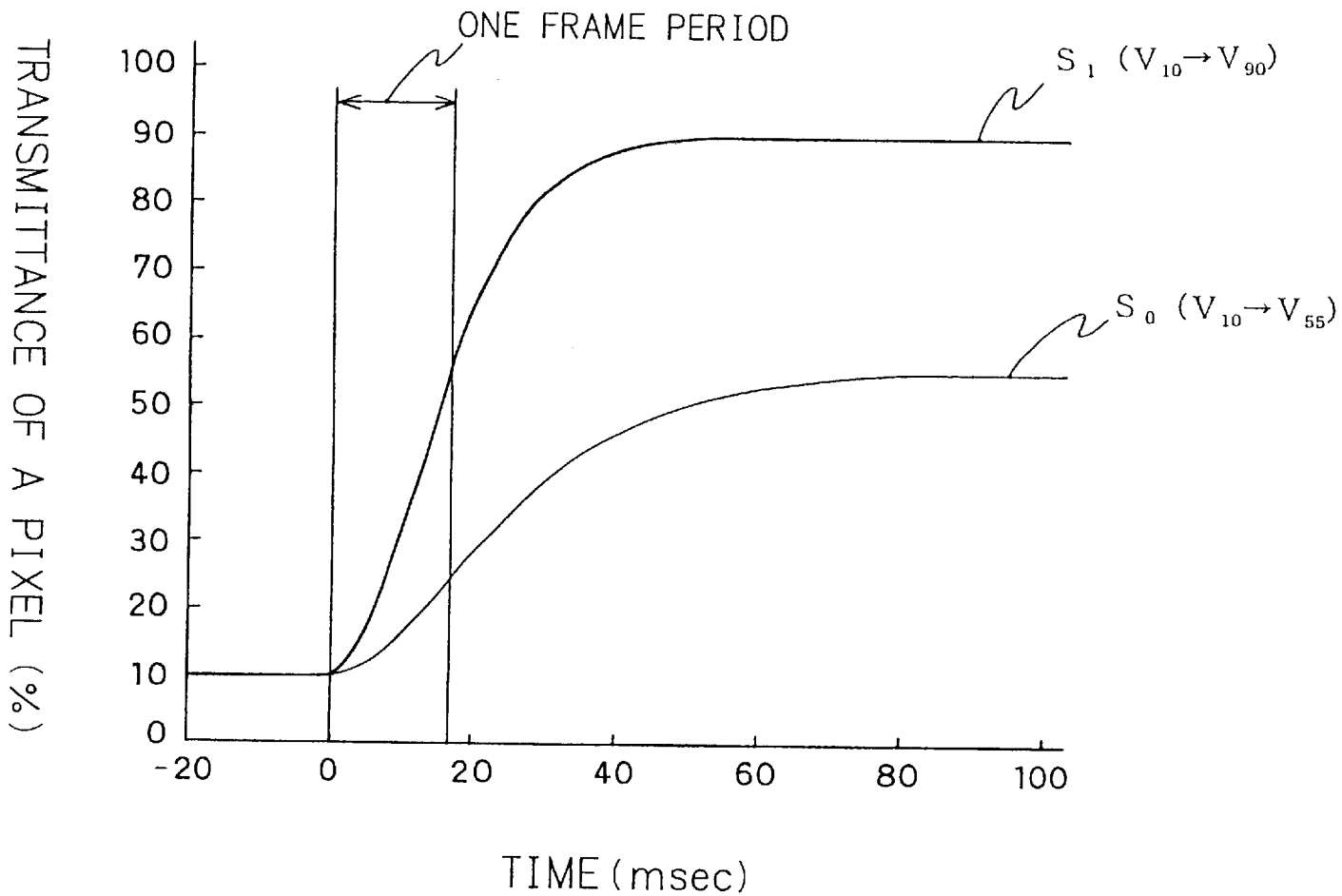
FIG. 1 is a view showing a relation between a voltage applied to the liquid crystal and a transmittance of the liquid crystal with respect to the conventional liquid crystal display device and the liquid crystal display device of the present invention.

As has been already described, in the case where for example, a desired light transmittance is 55% in the conventional liquid crystal display device, namely in the case where the an image signal is input which designates a display having a light transmittance of 55%, a voltage $V_{55}$ is applied to the liquid crystal, the voltage providing a light transmittance of 55% in the state in which a definite time passes away, and a response of the liquid crystal is almost completed. As a consequence, as shown by a thin line $S_0$ in FIG. 1, the transmittance of the liquid crystal does not reach 55% in one frame which causes deterioration in the image quality of the moving picture display.

Therefore, according to the present embodiment, a voltage at which the liquid crystal comes to have a desired transmittance after one frame period is applied to the liquid crystal in the current frame. For example, as shown with a solid line $S_1$ in FIG. 1, in the case where the desired transmittance is 55%, a voltage $V_{90}$ is applied at which voltage the transmittance becomes 90% in the state of the approximate completion of the response of the liquid crystal. The response of the liquid crystal becomes faster in speed as compared with the case of applying the voltage $V_{55}$, so that the transmittance of the liquid crystal after the lapse of one frame period can be set to approximately 55%.

In this manner, in Embodiment 1, the voltage applied in the current frame is set as a voltage at which the liquid crystal becomes a desired transmittance after one frame period with the result that a residual image is not observed and a contour of the object is not displayed in a blurred manner. Consequently, a liquid crystal display device having a favorable display quality of a moving picture can be obtained.

Embodiment 2

Figure 2:
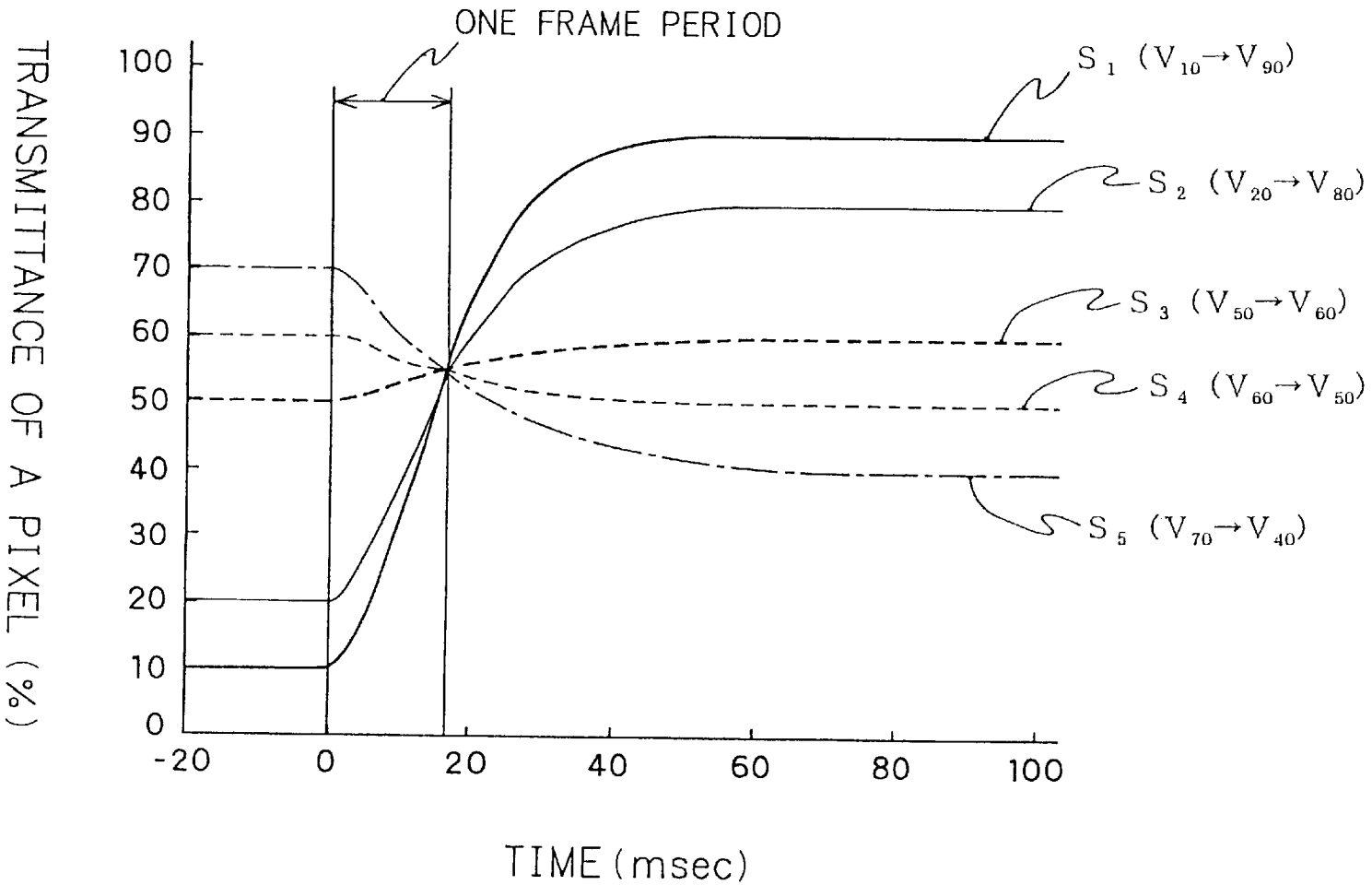
FIG. 2 is a view showing a relation between a voltage applied in the current field and a transmittance after the lapse of one field period.

FIG. 2 is a view showing an applied voltage and a change in a transmittance of a liquid crystal in a current frame.

It can be seen that a display having a transmittance of 55% can be obtained by applying a voltage $V_{80}$ at which the transmittance becomes 80% in the state of an approximate completion of the response of the liquid crystal in the current frame in the case where the transmittance of the former frame is 20% as shown with a thin line $S_2$ of FIG. 2. In a similar manner, as apparent from the curved lines $S_1$, $S_3$, $S_4$ and $S_5$, in the case where it can be seen that a desired transmittance of 55% can be obtained after one frame period by applying voltages $V_{90}$, $V_{60}$, $V_{50}$ and $V_{40}$ respectively in the case where the transmittances of the former frame is 10%, 50%, 60% and 70% respectively.

In this manner, the voltage at which a desired transmittance is provided after one frame period can be defined uniformly from the transmittance of the former frame. Consequently, the liquid crystal comes to have a desired transmittance after one frame period by using a two-dimensional chart (table), in which the transmittance of the former frame and the desired transmittance in the current frame are set as rows and columns respectively and a voltage to be applied to the liquid crystal is arranged at a cross point of the row and the column, with the result that a liquid crystal display device having a favorable display quality of the moving picture can be obtained.

Figure 3:
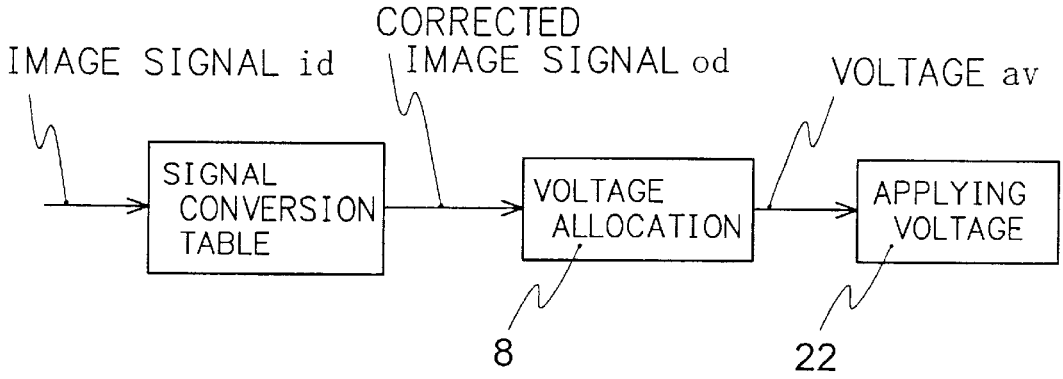
FIG. 3 is a block diagram for explaining a correction for the image signal according to the present invention.

As shown in FIG. 3, in the normal liquid crystal display device, an image signal for designating a desired transmittance of each pixel is input to a source driver 8, and the source driver 8 outputs a voltage av to be applied to the liquid crystal. Consequently, the above two-dimensional chart (table) may be a signal conversion table in which the image signal of the former frame and the image signal of the current frame are set as a row and a column, and an image signal after correction is arranged at a cross point. A voltage after correction, namely a voltage at which the liquid crystal comes to have a desired transmittance after one frame period is output by inputting the corrected image signal od on the signal conversion table to the source driver 8.

In this manner, the liquid crystal comes to have a desired transmittance after one frame period by using a two-dimensional chart (table) in which the image signal of the former frame and the image signal of the current frame are set as the row and the column respectively, an image signal after correction is arranged at a cross point of the row and the column, and by determining a voltage to be applied to the liquid crystal on the basis of the image signal after correction. As a consequence, a liquid crystal display device having a favorable image quality of a moving picture can be obtained.

Embodiment 3

Figure 4:
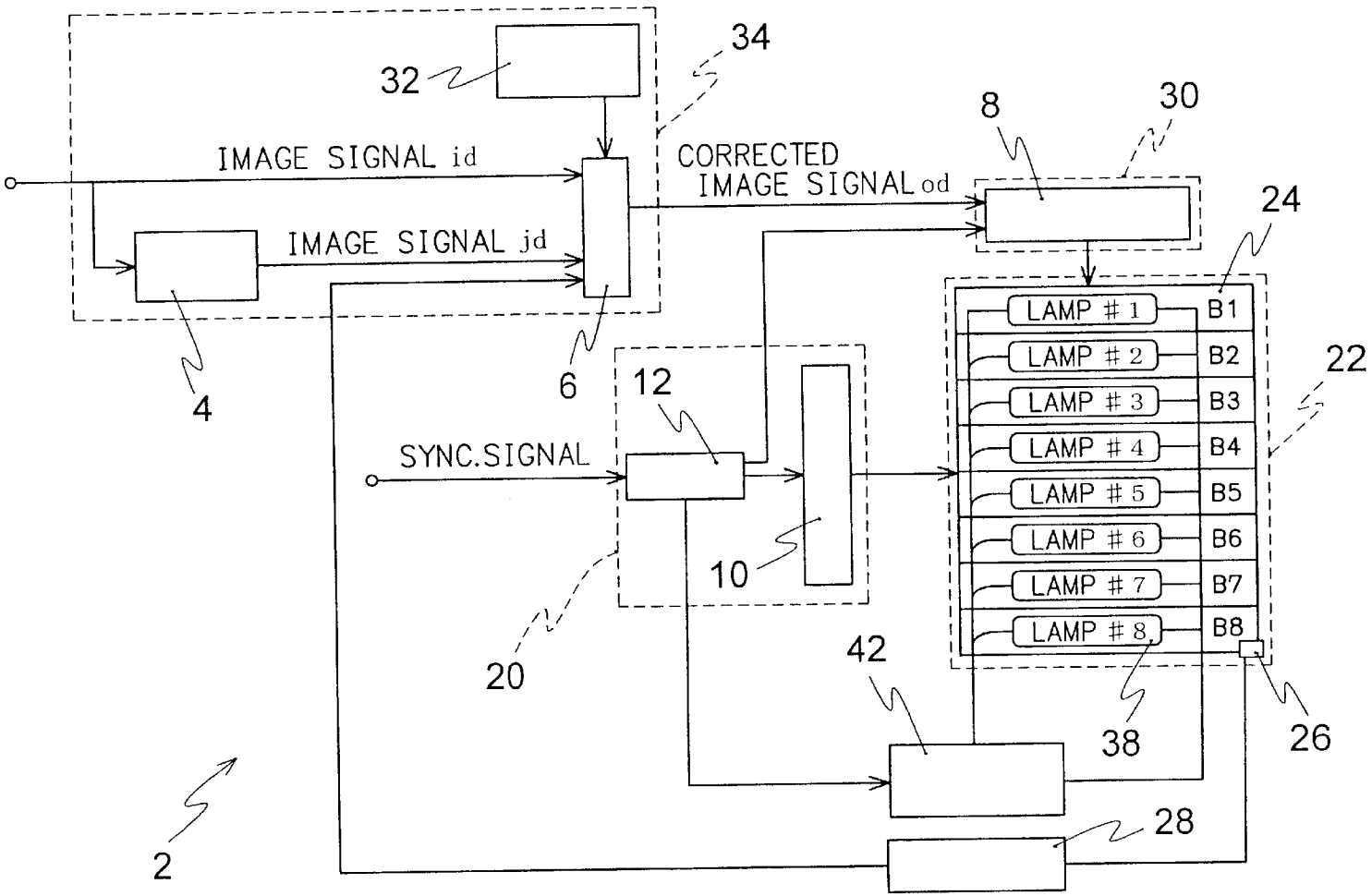
FIG. 4 is a block diagram showing a liquid crystal display device according to the present invention.

FIG. 4 is a view showing a structure of a liquid crystal display device according to Embodiment 3.

As shown in FIG. 4, the liquid crystal display device 2 according to Embodiment 3 comprises an image signal processing circuit 34, a vertical driving circuit 20, a horizontal driving circuit 30 and a display panel 22. A display are 24 is formed in a display panel 22. The display area 24 is illuminated from the rear side with a backlight. In the display area 24 of the display panel 22, the pixels are arranged in a matrix-like rows and columns configuration and a switching device such as a thin film transistor (hereinafter referred to as a TFT) is connected to each of the pixels. Incidentally, in FIG. 4, the pixel and the TFT are omitted. The vertical driving circuit 20 comprises a gate driver 10 connected to the gate electrode of the TFT via the gate wiring, and a control circuit 12 for sending a timing signal to the gate driver 10. Whole display area is scanned while driving each of the TFT's for each row on the basis of the synchronization signal supplied from the outside. The horizontal driving circuit 30 comprises a source driver 8 driven by receiving a timing signal from the control circuit 12 to write a signal to a pixel in the row selected with the vertical driving circuit 20.

In the liquid crystal display device according to the present embodiment, the image signal processing circuit comprises a frame memory 4, a processor 6, and a parameter memory 32. In the parameter memory 32, the two-dimensional chart (signal conversion table) explained in Embodiment 2 is stored. FIG. 5 is a view showing an example of a signal conversion table. In the signal conversion table 32*a*, an image signal jd displayed in the former frame as a row and an image signal id to be displayed in the current frame as a column have a transmittance which is represented as a gradations of 256 stages. Furthermore, an image signal supplied to the source driver 8 in the current frame is arranged at the cross point as output data od represented with 256 gradations.

In the liquid crystal display device according to the present embodiment, the current frame image signal id from the signal source is supplied to the processor 6 and the frame memory 4. The frame memory 4 memorizes the current frame signal id, and the memorized current frame image signal is read as a previous frame image signal jd after the lapse of one frame period. The processor 6 applies the read previous frame image signal jd and the current frame image signal id to the row and the column of the signal conversion table 32*a* to output the output data at the crossing point as an corrected image signal od.

Each output data of the signal conversion table 32*a* is determined as a gradation data corresponding to a voltage required for the change from the transmittance of the previous frame image signal to the transmittance of the current frame image signal within one frame period. For example, in the case where the gradation level of the previous frame image signal is of "64" while the current frame image signal has a gradation level of "128", a value larger than the gradation level of "128", namely, the gradation level of "144" for example is set as output data so that a difference between both gradation levels is made larger. A voltage corresponding to the gradation level of "144" is applied to the liquid crystal, and a response of the liquid crystal is accelerated with the result that a display is provided which has a designated gradation level of "128" after the lapse of one frame period.

Embodiment 4

In the previous Embodiment 3, an image signal is corrected by using a signal conversion table which agrees with the number of the gradation levels of the current frame image signal supplied from the signal source. That is, a signal conversion table of "256×256" is used in which the previous image signal jd and the current frame image signal id having 256 gradation levels are set as the row and the column respectively.

On the other hand, in Embodiment 4, as shown in FIG. 6, the signal conversion table 32*a* is set as a table of "8×8" in which respective eight gradation levels out of the previous image signal and the current image signal having 256 gradation levels are set as the row and the column, and output data having 256 gradation levels is provided at a crossing point between the row and the column.

Consequently, the size of the signal conversion table which requires 64 kilobytes is reduced to about one thousandth, namely 64 bytes so that the capacity of the parameter memory for storing the signal conversion table can be reduced and the number of data lines for connecting the parameter memory and the processor can be largely reduced.

At this time, the previous frame image signal jd and the current frame image signal id have 256 gradation levels whereas the signal conversion table 32*a* only comprises ouput data corresponding to the previous frame image signal c(jd) and the current frame image signal c(id) both having only eight gradation levels. Then, according to the present embodiment, by conducting a two-dimensional linear interpolation at the processor 6, output data is calculated which corresponds to the previous frame image signal and the current frame image signal having 256 gradation levels from the output data corresponding to the previous frame image signal and the current frame image signal having eight gradation levels.

Figure 7:
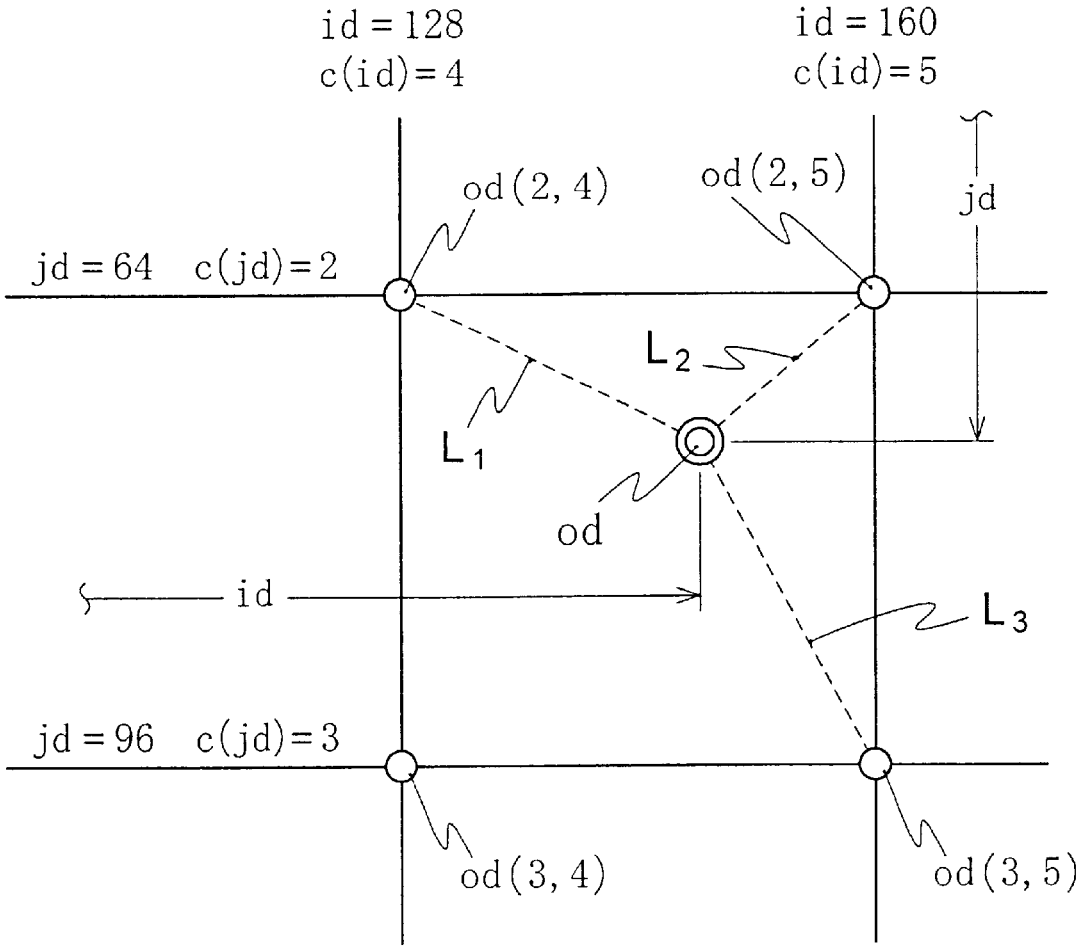
FIG. 7 is a view for explaining a calculation of an output data with a linear interpolation.

The linear interpolation technique will be explained by using FIG. 7. Suppose that the gradation level of the previous frame image signal jd read from the frame memory 4 is "72" and the gradation level "72" of 256 gradation levels is set between the gradation "2" and the gradation "3" of eight gradations. On the other hand, the gradation level of the current frame image signal id supplied from the signal source is "148", and the gradation is set between the gradation "4" and the gradation "5" of eight gradation levels. In this case, the position on the signal conversion table of FIG. 6 showing the image signal (jd, id)=(72, 148) is as shown in FIG. 7. That is, the image signal (jd, id)=(72, 148) is located inside of the rectangle formed with four points of [c(jd), c(id)]=(2, 4), (2, 5), (3, 4) and (3, 5) and further located inside of a triangle formed with three points [c(jd), c(id)]=(2, 4), (2, 5) and (3, 5).

Then, the processor 6 calculates distances $L_1$, $L_2$ and $L_3$ between these three points and the image signal (jd, id) while the output data od (2, 4), od(2, 5) and od(3, 5) of these three points are read out from the signal conversion table 32*a*. Then, a distance with the read output data od(2, 4), od(2, 5) and od(3, 5) determines final output data od so as to become proportional to the distances $L_1$, $L_2$, and $L_3$.

In this manner, according to the present embodiment, the signal conversion table 32*a* is configured so as to correspond to eight gradation levels respectively out of the previous frame image signal and the current frame image signal having 256 gradation levels, and is configured so as to output the output data corresponding to the previous frame image signal and the current frame image signal having 256 gradation levels through the linear interpolation at the processor. Consequently, the capacity of the parameter memory for storing the signal conversion table can be reduced. Furthermore, the number of data lines for connecting the parameter memory and the processor can be largely reduced.

Incidentally, according to the present embodiment, there is shown an example in which the signal conversion table 32*a* is provided in correspondence to the previous frame image signal and the current frame image signal having eight gradation levels. However, it goes without saying that the number of gradation levels may be other gradation levels such as 16 gradation levels or 32 gradation levels. In the signal conversion table 32*a*, furthermore, the number of gradation levels of the previous frame image signal and the number of gradation levels of the current frame image signal is not necessarily required to be the same.

Embodiment 5

In the previous Embodiments, the image signal of the current frame supplied from the signal source is memorized in the frame memory 4 and is read as the previous frame image signal jd after the lapse of one frame period. That is, the image signal having 256 gradation levels is memorized in the frame memory 4.

On the other hand, in the present embodiment, the current frame image signal id having 256 gradation levels is converted into the current frame image signal c(id) having eight gradations to be memorized in the frame memory 4. The number of gradation levels can be easily converted by extracting an upper place number bits of the image signal. In the case where the current frame image signal id having 256 gradation levels is converted to the current frame image signal c(id) having eight gradation levels, the upper place three bits may be extracted from the current frame image signal id of eight bits (that is, 256 gradation levels).

The converted image signal c(id) is stored into frame memory and read out as the previous frame image signal c(jd) after the lapse of one frame period. The processor 6 applies the read previous frame image signal c(jd) and the current frame image signal id to the row and the column of the signal conversion table 32*a* of FIG. 6 to output the output data at the crossing point as an image signal od of FIG. 4.

At this time, the current frame image signal id has 256 gradation levels whereas the signal conversion table 32*a* of FIG. 6 only comprises output data corresponding to the current frame image signal c(id) having eight gradation levels. Consequently, one-dimensional linear interpolation is conducted to calculate output data corresponding to the current frame image signal id having 256 gradation levels. That is, for example, the gradation levels of the current frame image data is "144" and corresponds to the midway between the gradation "4" and the gradation "5" of the current frame image signal c(id) having eight gradations, an intermediate value between the two output data corresponding to the gradation "4" and the gradation "5" of the signal conversion table 32*a* may be set to output data corresponding to the gradation "144" of 256 gradations.

As has been already described, according to the present embodiment, the current frame image signal after the bit conversion is memorized in the frame memory. Consequently, the memory capacity required for the frame memory and the number of data lines for connecting the frame memory and the processor can be largely decreased, and the circuit scale of the image signal processing circuit can be reduced in size.

Furthermore, the signal conversion table is configured as a table of 8×8 corresponding to eight gradation levels of the previous frame image signal and the current frame image signal respectively. Consequently, the capacity of the parameter memory for storing the signal conversion table and the number of data lines for connecting the parameter memory and the processor can be largely decreased so that the circuit scale of the image signal processing circuit can be decreased.

Incidentally, the number of rows and the number of columns of the signal conversion table are not required to be the same. For example, in correspondence to the previous image signal having eight gradation levels and the current frame image signal having 256 gradation levels, a signal conversion table of eight rows and 256 columns may be provided. In this case, the linear interpolation is not required to be conducted at the processor 6. Consequently, the size of the parameter memory becomes rather large, but the calculation load of the processor can be reduced.

Furthermore, the number of gradation levels of the image signal stored into the frame memory and the number of gradation levels of the previous frame image signal in the signal conversion table may be different from each other. That is, the signal conversion table 32*a* is configured in correspondence to the previous image signal having eight gradation levels while the image signal memorized in the frame memory may be the gradation levels of four bits (namely, 16 gradation levels) or more. However, in this case, the two-dimensional linear interpolation is required in the same manner as described in above Embodiment 4.

Embodiment 6

In the previous Embodiment 5, the signal conversion table 32*a* is configured in correspondence to eight gradation levels out of 256 gradation levels of previous frame image signal and the current frame image signal, and is configured to output the output data corresponding to the previous frame image signal and the current frame image signal having 256 gradation levels through linear interpolation at the processor.

On the other hand, the signal conversion table 32*a* and the signal conversion interpolation table 32*b* are provided in correspondence to the previous frame image signal and the current frame image signal of eight gradation levels out of 256 levels, and are configured to output the output data corresponding to the current frame image signal having 256 gradation levels from the output data of the signal conversion table 32*a* and the interpolation differential data Δod of the signal conversion interpolation table 32*b*.

The current frame image signal c(id) which is converted into eight gradation levels is memorized in the frame memory 4 to be read as the previous frame image signal c(jd) after the lapse of one frame period. The processor 6 applies the read previous frame image signal c(jd) and the current frame image signal id to the row and the column of the signal conversion table 32*a* of FIG. 6 to output the output data at the crossing point as image data od.

However, at this time, the current frame image signal id has 256 gradation levels whereas the signal conversion table 32*a* of FIG. 6 only comprises output data corresponding to the current frame image signal having eight gradation levels. Consequently, the output data is calculated which corresponds to the current frame image signal id having 256 gradation levels by using a signal conversion interpolation table 32*b* shown in FIG. 8.

For example, the gradation of the current frame image signal id is "144" and corresponds to a halfway between the gradation "4" and the gradation "5" of the current frame image signal c(id) having eight gradation levels, the output data od and the interpolation differential data Δod corresponding to the gradation "4" of current frame image signal c(id) is read from the signal conversion table 32*a* and the signal conversion interpolation table 32*b*. Consequently, the output data corresponding to the current frame image signal id having 256 gradation levels is calculated by using the signal conversion interpolation table 32*b* shown in FIG. 8.

For example, the current frame image signal id has "144" gradation levels. In the case where the gradation level corresponds to the halfway between the gradation "4" and the gradation "5", the output data od and the interpolation differential data Δod corresponding to the gradation is read from the signal conversion table 32*a* and the signal conversion interpolation table 32*b*. Then, a difference between the gradation "144" in the 256 gradation levels and "4" in eight gradation levels is calculated to be multiplied with the interpolation differential data Δod corresponding to gradation "4" in eight gradation levels. The multiplication result is added to the output data od to be supplied to the source driver 8 as final output data.

In this manner, according to the present embodiment, it is so configured that a signal conversion table and a signal conversion interpolation table are provided each of which comprises output data and interpolation differential data respectively in correspondence to the eight gradation levels out of the previous frame image signal and the current frame image signal to conduct interpolation of output data by using the interpolation differential data. Consequently, the size of the parameter memory for storing the signal conversion table and the signal conversion interpolation table can be largely reduced while the number of the data line for connecting the parameter memory and the processor is decreased, and the scale of the circuit can be reduced. Furthermore, the interpolation calculation at the processor is simplified, and the calculation amount is decreased so that the circuit scale can be reduced.

Furthermore, since the bit length of the image signal is converted and the data amount is decreased to be memorized in the frame memory, the size of the frame memory can be reduced, and the circuit scale can be reduced by decreasing the number of data lines for connecting the frame memory and the comparison circuit.

Embodiment 7

In the liquid crystal display device, the response characteristic of the liquid crystal, namely the rise characteristic and the fall characteristic of the transmittance change with the change in the peripheral temperature and the heating of the backlight arranged on the rear surface of the display panel. Therefore, the liquid crystal display device according to Embodiment 7 is characterized in that the voltage applied to the liquid crystal changes with the temperature.

As shown in FIG. 4, the liquid crystal display device according to Embodiment 7 comprises a temperature sensor 26 and a temperature detection circuit 28. Furthermore, inside of the parameter memory 32, a plurality of signal conversion tables 32*a* are provided which corresponds to the temperature condition. Furthermore, the liquid crystal display device comprises a signal conversion interpolation table 32*b* when needed.

The temperature detection circuit 28 detects the temperature of the liquid crystal with a signal from the temperature sensor 26 to transmit the temperature to the processor 6. The processor 6 selects as to which of the plurality of signal conversion tables 32*a* (and a signal conversion interpolation table 32*b*) is used on the basis of this temperature information.

Generally, the liquid crystal is slow in response at the time of a low temperature while the liquid crystal is fast in response at the time of a high temperature. Consequently, for example, apart from the signal conversion table 32*a* at the normal time, a signal conversion table 32*a* for a low temperature in which a difference between the current frame image signal and the previous frame image signal is enhanced and a signal conversion table 32*a* for a high temperature in which a difference between the current frame image signal and the previous frame image signal is not enhanced so much are prepared. One of these signal conversion tables may be selected and used on the basis of information from the temperature detection circuit. The liquid crystal can always have a desired transmittance after one frame period without being affected by the peripheral temperature and the heat of the backlight with the result that a liquid crystal display device having a favorable display quality of the moving picture can be obtained.

Furthermore, instead of providing the plurality of signal conversion table 32*a*, the temperature dependency with respect to each output data of the signal conversion table 32*a* and a signal conversion table 32*a* for a standard temperature is memorized, and an output data of the signal conversion table 32*a* may be corrected based on the temperature of the liquid crystal being detected and the temperature dependency of the output data.

Incidentally, as the temperature sensor 26, a thermocouple may be stuck on the surface of the display panel. Furthermore, the resistance of the liquid crystal and the capacity thereof change with the temperature. Consequently, a dummy electrode which is not used for displaying images may be provided in the display panel and can be used as a temperature sensor 26 by observing the resistance or the capacitance of the liquid crystal.

Embodiment 8

In Embodiment 8, furthermore, in order to suppress the "ghost" and the "motion blur" along with it, the backlight is lighted after a definite time has passed from the writing of the image signal for each frame.

Figure 9:
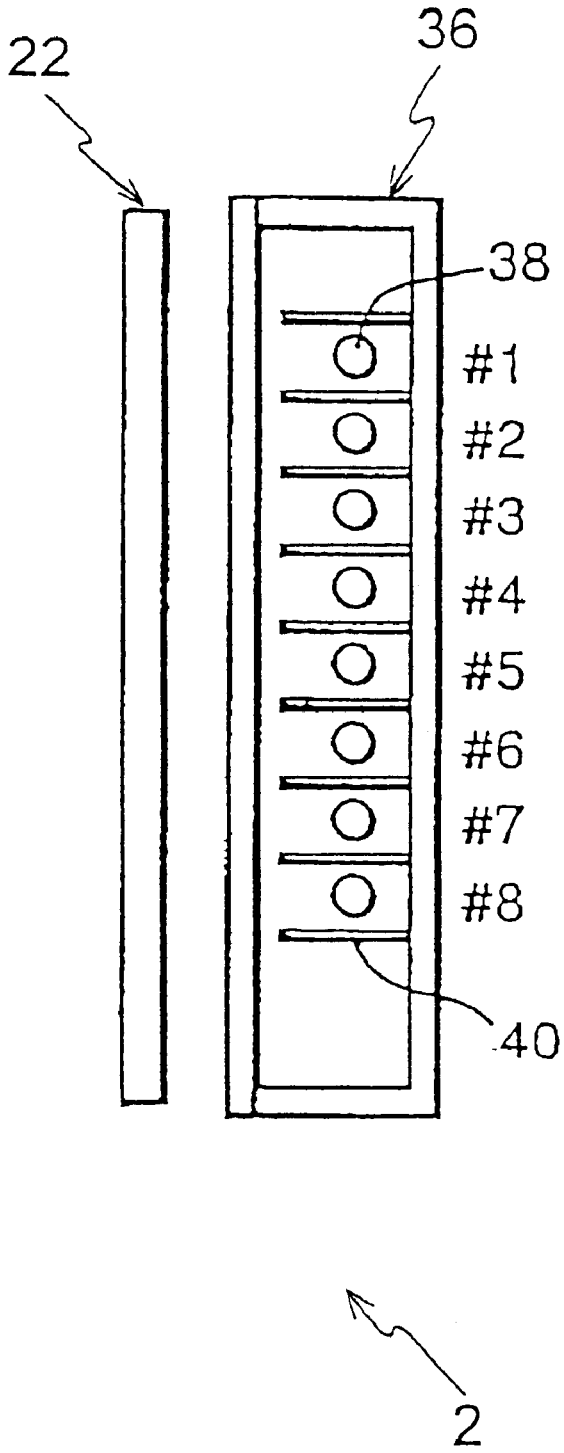
FIG. 9 is a side surface sectional view showing a liquid crystal display device according to the present invention.

As shown in FIG. 4, in the liquid crystal display device according to the present embodiment, the display area 24 of the display panel 22 is divided into eight horizontal stripe-like display blocks B1 through B8 in a row direction of the pixel, and the lamp 38 is arranged for each of the display block. The lamp 38 is subsequently lighted with the backlight lighting circuit 42 in accordance with the timing signal from the control circuit 12. Furthermore, as shown in the side surface sectional view of FIG. 9, each lamp 38 of the backlight 36 is mutually partitioned with a light shielding wall 40 so that light is not leaked to the adjacent display block. Incidentally, an attempt is made to improve luminance by providing a plurality of lamps 38 for each display block.

Figure 10:
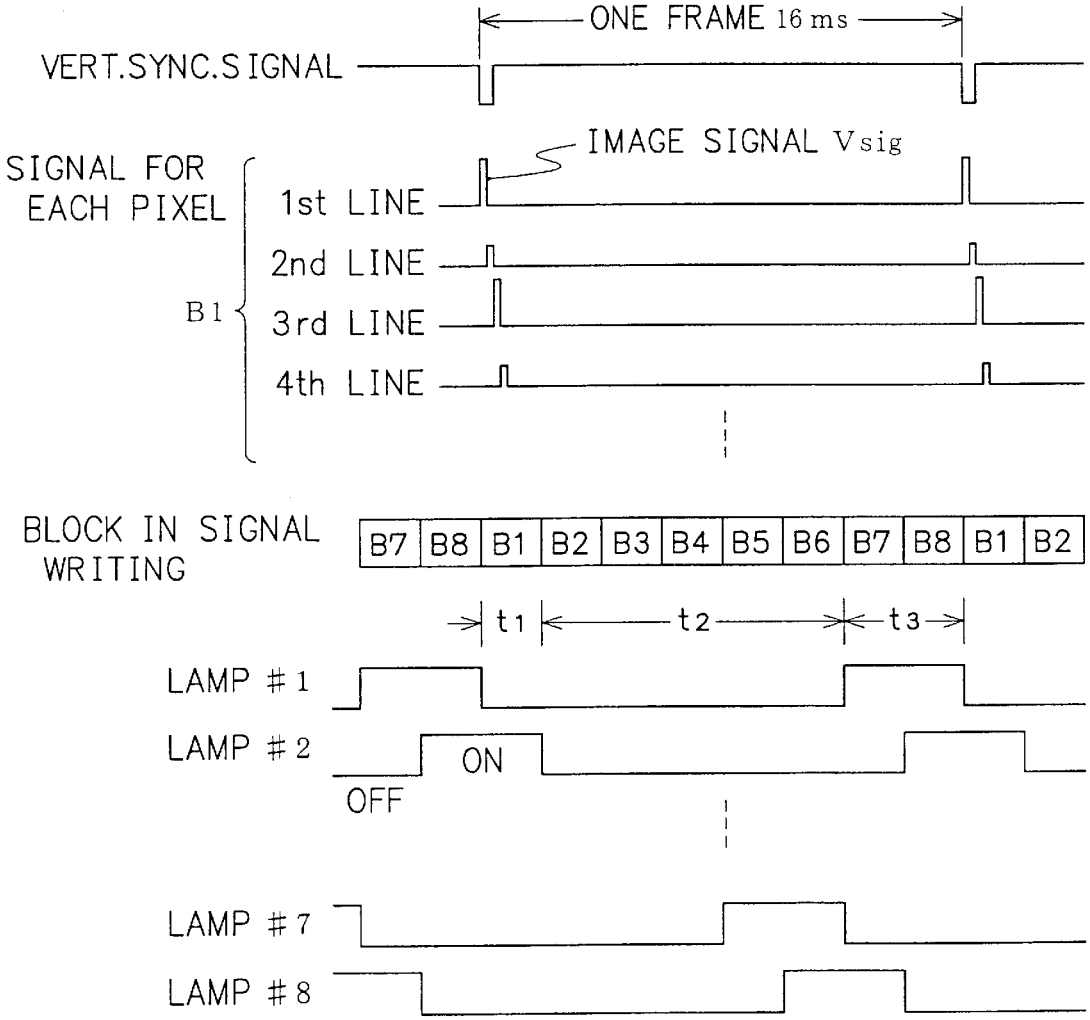
FIG. 10 is a view showing lighting timing of a backlight in the liquid crystal display device according to the present invention.

FIG. 10 is a timing chart showing a lighting timing of the backlight. A scanning line, that is row of pixels, of the display area 24 is scanned in order from the first row, so that a voltage is applied to the liquid crystal of the pixel connected to the scanning line. In an example shown in FIG. 10, as described above, the display area 24 is partitioned into eight display blocks B1 through B8 in a row direction. One display block is scanned in about 2 msec which is one eighth of one frame period.

The display block B1 is noted and explained. A lamp #1 for illuminating the display block B1 is lighted for a lighting period $t_3$ which is equal to a scanning period for two blocks after the lapse of a delay period $t_2$ equal to the scanning period for five blocks after the display block B1 is scanned in the scanning period $t_1$. Lamps #2 through #8 for illuminating the display blocks B2 through B8 are operated in the same manner as the lamp #1 with a delay for the scanning period for one block respectively.

In this manner, as a result of the restriction of the lamp lighting period of the backlight, the display panel 22 provides an impulse type light emission with the result that a sharp image free from the "motion blur" can be obtained.

Figure 11:
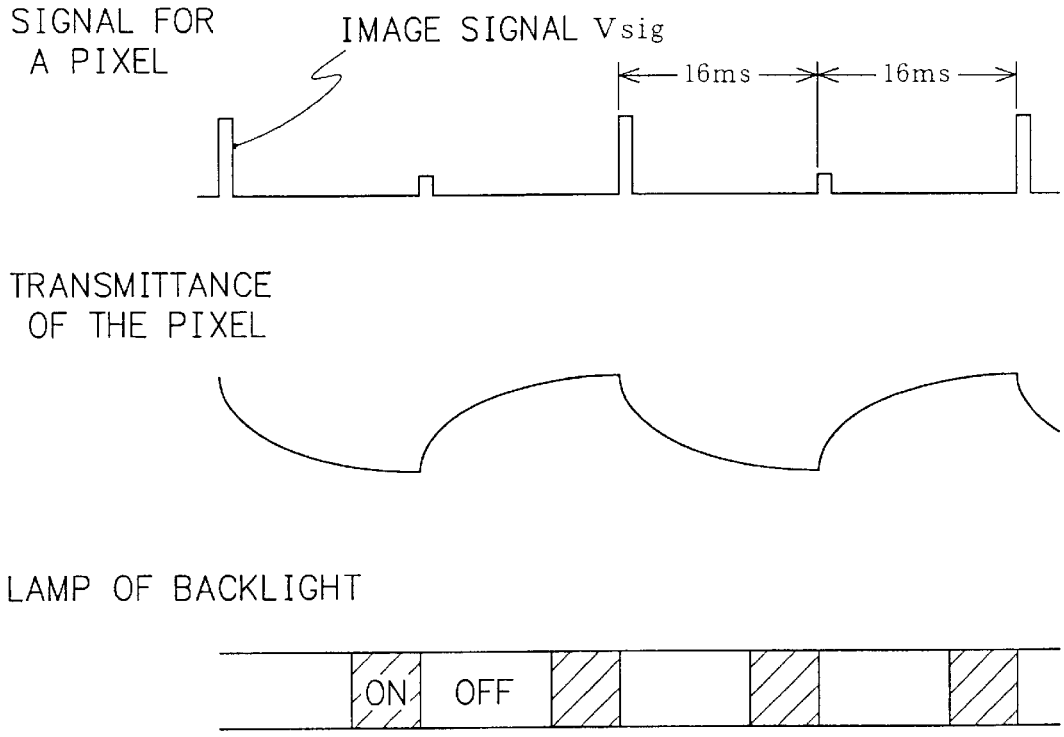
FIG. 11 is a view showing a relation between the transmittance of the liquid crystal and the lighting timing of the backlight in the liquid crystal display device according to the present invention.

Furthermore, the transmittance of the liquid crystal in the case of an alternate display of white and black on the pixel is shown in FIG. 11. As apparent here, the lamp #1 is lighted with a delay period $t_2$ so that the lamp is not lighted in a rise (fall) period of the transmittance of the liquid crystal. As a consequence, observers are prevented from observing the transition state of the transmittance of the liquid crystal, and observers can observe only the state in which the response of the liquid crystal is sufficiently completed and a desired transmittance is attained. Consequently, the state of the liquid crystal of the previous frame is not observed as the "ghost", and the display quality of the moving picture is further improved.

Incidentally, in the present embodiment, the lighting time of the lamp in each display block is about 4 msec. The lighting time ratio of the backlight is about 1/4. The lighting time ratio of the backlight can be adjusted by changing the delay period $t_2$. The ratio may be set appropriately in consideration of a balance between the display of the moving picture and the screen luminance. From the viewpoint of the display of the moving picture, preferably the lighting time ratio is set to be small (that is, $t_2$ is set to be long while $t_3$ is set to be short) in such a manner that the transmittance of the pixel is stabilized and light is emitted. On the other hand, from the viewpoint of the luminance of the screen, preferably the lighting time ratio is set to be large (that is, $t_2$ is set to be short while $t_3$ is set to be long).

Embodiment 9

As described above, the luminance of the display panel can be controlled by changing the ratio of the turning off period of the lamp (sum total of the scanning period $t_1$ and the delay period $t_2$) and the lighting period $t_3$. However, the luminance of the backlight, namely, the display panel can be further controlled by changing a current value which is allowed to flow through the lamp.

Figure 12:
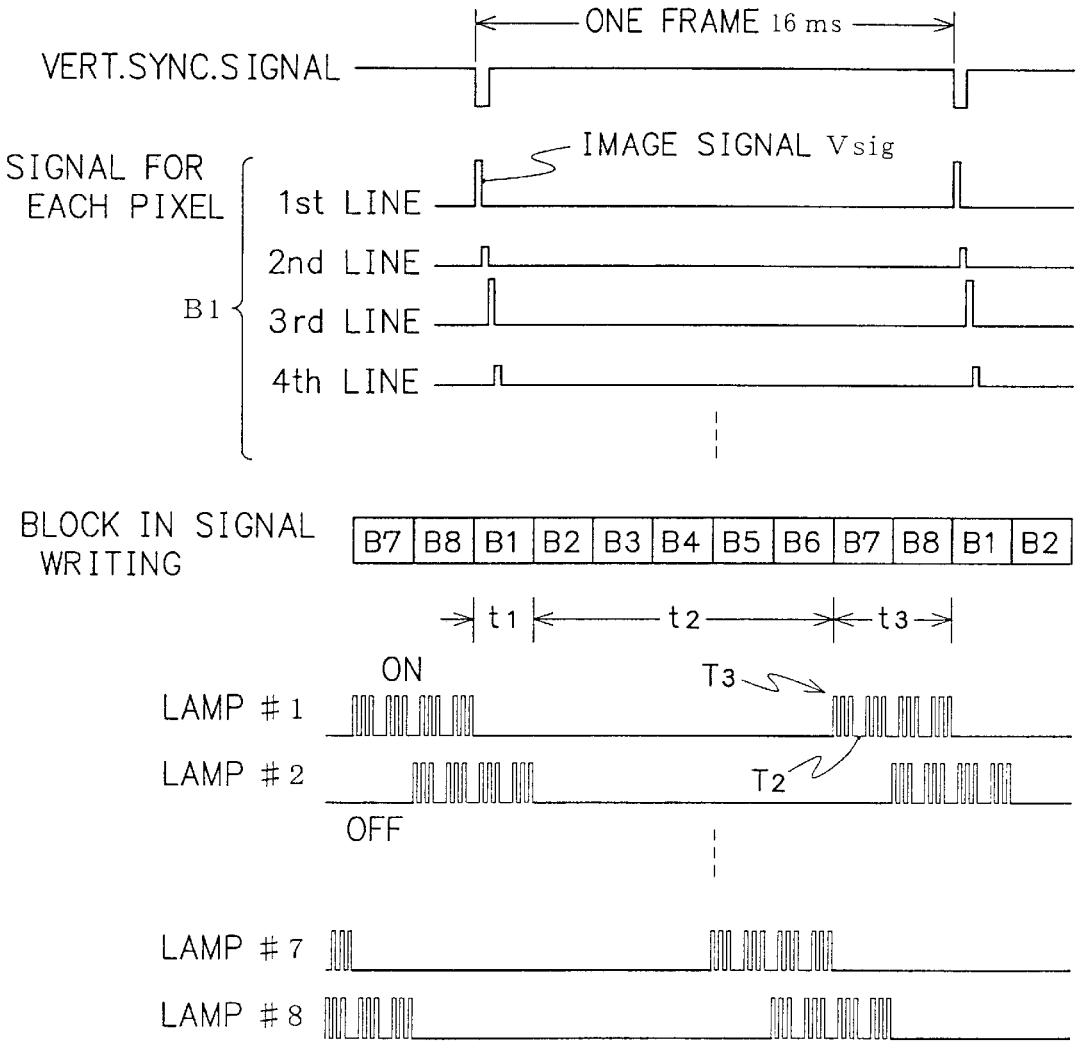
FIG. 12 is a view showing lighting timing of the backlight in the liquid crystal display device according to the present invention.

Furthermore, as shown in FIG. 12, a fluorescent lamp in which the lighting period $t_3$ of the lamp is further time divided and is driven preferably at hundreds of Hz, preferably 200 through 300 Hz, the luminance of the backlight or the display panel can be controlled by controlling a ratio of the turning on sub-period $T_3$ and the turning off sub-period $T_2$. Consequently, in the case where the turning on period $t_3$ of the lamp is changed, the luminance of the backlight, namely the display panel can be set to the same level by controlling the ratio of the turning on time $T_3$ and the turning off time $T_2$.

Figure 13:
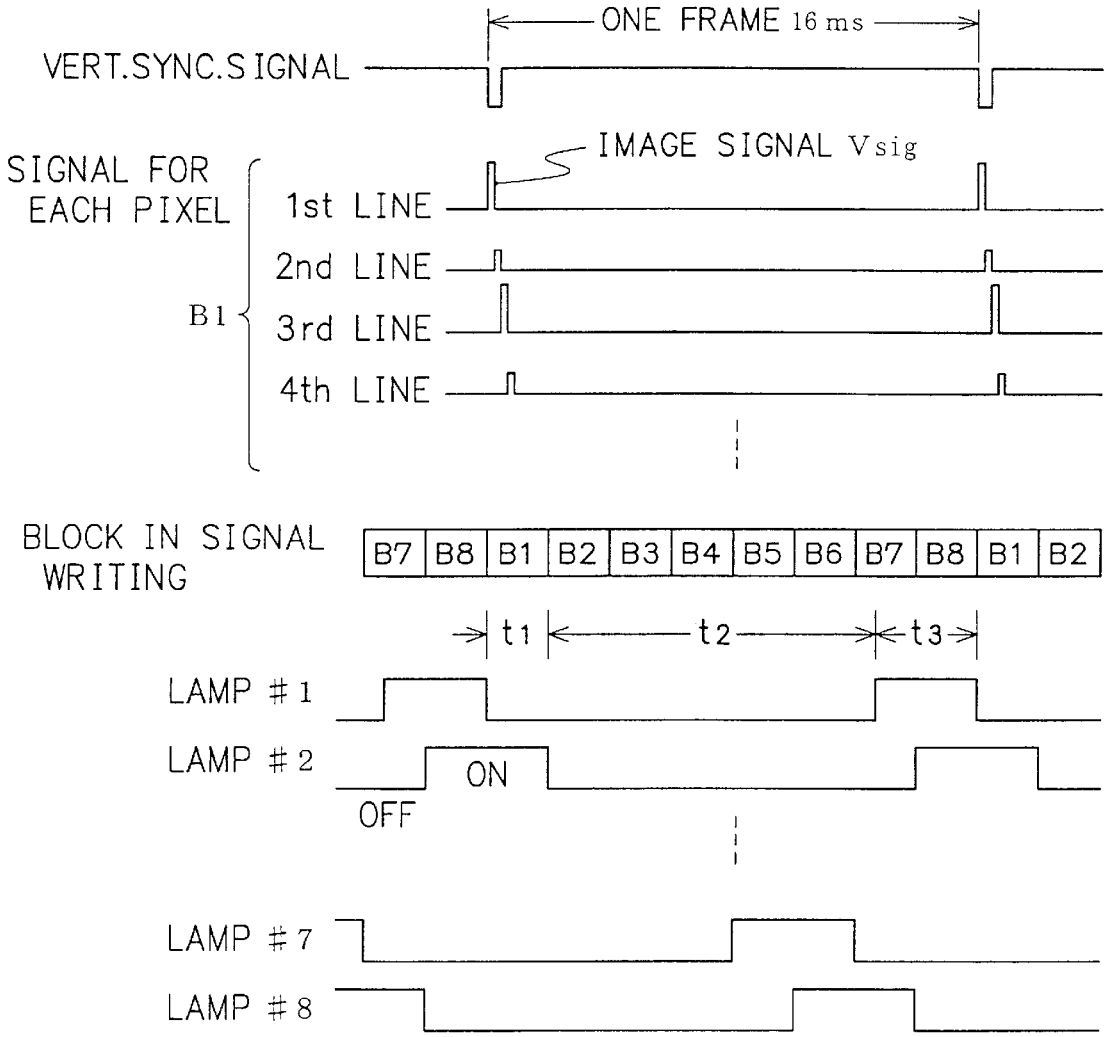
FIG. 13 is a view showing lighting timing of the backlight in the liquid crystal display device according to the present invention.

Furthermore, in the case where the luminance is scattered between respective lamps, and in the case where the luminance is scattered between respective display blocks, the luminance can be evenly controlled by appropriately adjusting the turning on period $t_3$ of each lamp as shown in FIG. 13. FIG. 13 is a view showing an example in which the turning on period $t_3$ of the lamp #1 is shortened.

Furthermore, the current value which is allowed to flow each lamp is appropriately adjusted, the luminance of the display panel can be made uniform when, for example, a larger current is allowed to flow through the lamp of the display block having a lower luminance.

Furthermore, in an example as shown in FIG. 12 in which the turning on period $t_3$ of the lamp is further time divided, the luminance of the display panel can be evenly controlled by appropriately setting the ratio of the turning on sub-period $T_3$ and the turning off sub-period $T_2$ for each lamp.

Embodiment 10

In the Embodiments described above, there is explained an example in which the lamp 38 is provided in each of the display blocks, and each display block is illuminated with each of these lamps. In the present embodiment, each display block is separately illuminated by providing a shutter which can be partly opened and closed in correspondence with each display block.

Figure 14:
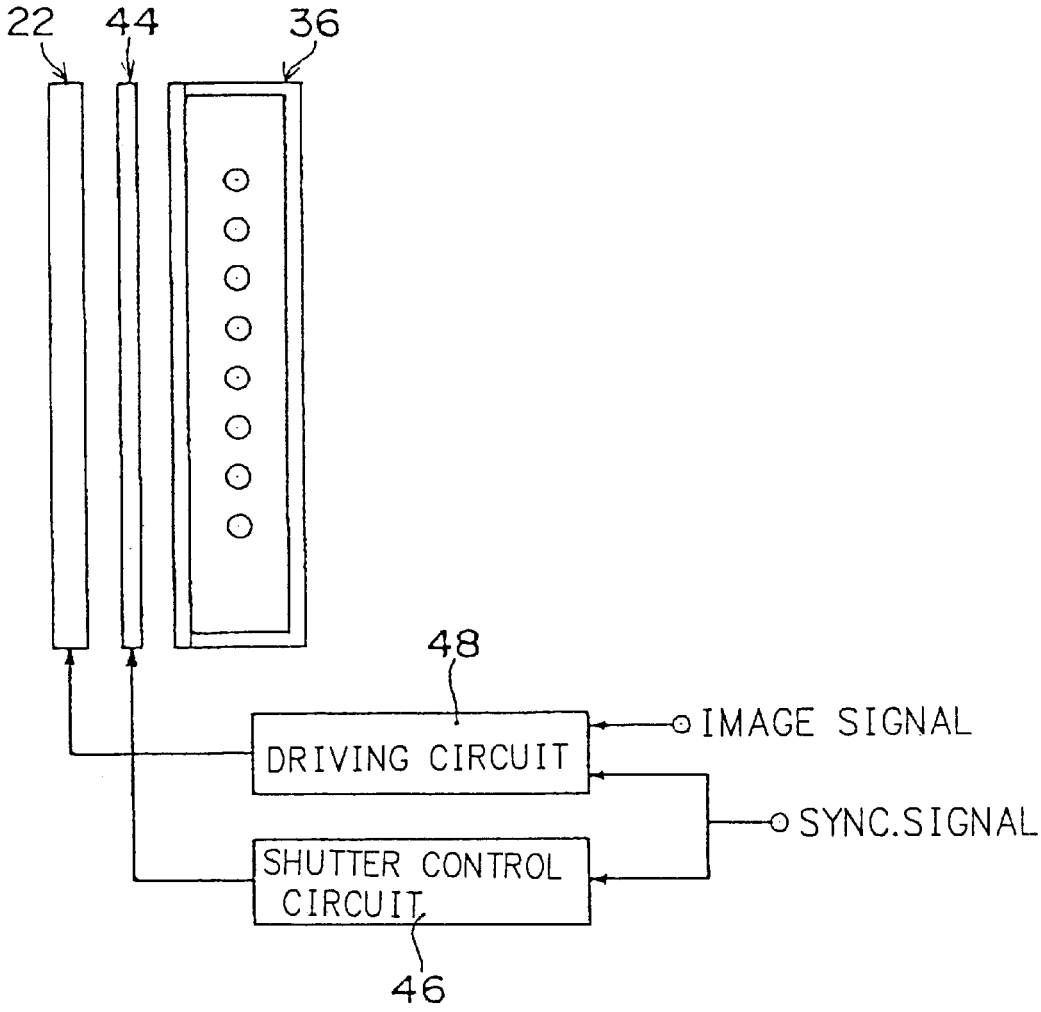
FIG. 14 is a side surface sectional view showing a liquid crystal display device according to the present invention.

FIG. 14 is a diagram showing a liquid crystal display device according to the present embodiment. A shutter 44 is provided between the display panel 22 and the backlight 36. The shutter 44 is divided into regions for each of the display blocks B1 through B8 of the liquid crystal panel 22 shown in FIG. 4 so that the shutter can be opened and closed for each of the display blocks B1 through B8. In accordance with the synchronization signal from the outside, the regions of shutter 44 are subsequently opened and closed. The opening and closing timing for each block is the same as the turning on timing of the lamp 38 in FIG. 10 and Embodiment 8.

As the shutter 44, a ferroelectric liquid crystal panel can be used which is not appropriate for a gradation display but has a fast response speed. In order to divide the shutter for each display block and open and close the shutter, the ferroelectric liquid crystal panel is divided for each display block and is opened and closed, the electrode of the ferroelectric liquid crystal panel is divided and formed for each display block.

Incidentally, according to the present embodiment, there is explained a transmitting type liquid crystal panel in which a liquid crystal panel 22 transmits the light of the backlight to provides a display. In the case where the liquid crystal panel 22 is a reflection type liquid crystal panel which provides a display with the reflection of the external light, a shutter 44 is provided before the liquid crystal panel 22 (on the side of the observer) to conduct a similar operation.

Embodiment 11

Normally, a signal of television broadcasting and a reproduction signal of VTR are so-called interlace signal in which scanning lines, i.e. rows of pixels, are scanned by skipping one line. That is, the even number-th scanning line is subsequently scanned in the even number-th frame while the odd number-th scanning line is subsequently selected in the odd number-th frame. As a result, an image signal is written once in two frames for each pixel. In this manner, in the interlaced type, one image is displayed in two frames so that each frame is referred to as a field. Two fields are referred to as one frame as a package.

According to the present embodiment, the liquid crystal display device for displaying the interlaced type image signal is characterized in that an image signal is once written to one frame (that is, two fields) for each pixel, and an erasure signal is written once to one frame. That is, in the even number-th field (hereinafter referred to as even number field), the image signal is written into the pixels of the even number rows while an erasure signal is written into the pixels of odd number lows to adjust the potential of each pixels onto same level. In the odd number-th field (hereinafter referred to as the odd number field), the image signal is written to the pixels of the odd number rows while the erasure signal is written to the pixels of the even number rows.

Furthermore, the liquid crystal display device has a function of correcting the original image signal corresponding to the gradation to be displayed to a direction in which a difference in gradation with the gradation of the erasure signal becomes larger to supply this corrected image signal to a source driver.

Before writing the image signal, the erasure signal with the same gradation is written into all the pixels to eliminate the influence of the display in the previous frame with the result that optical response time of each pixel can be uniformed irrespective of the display image of the previous frame.

Figure 15:
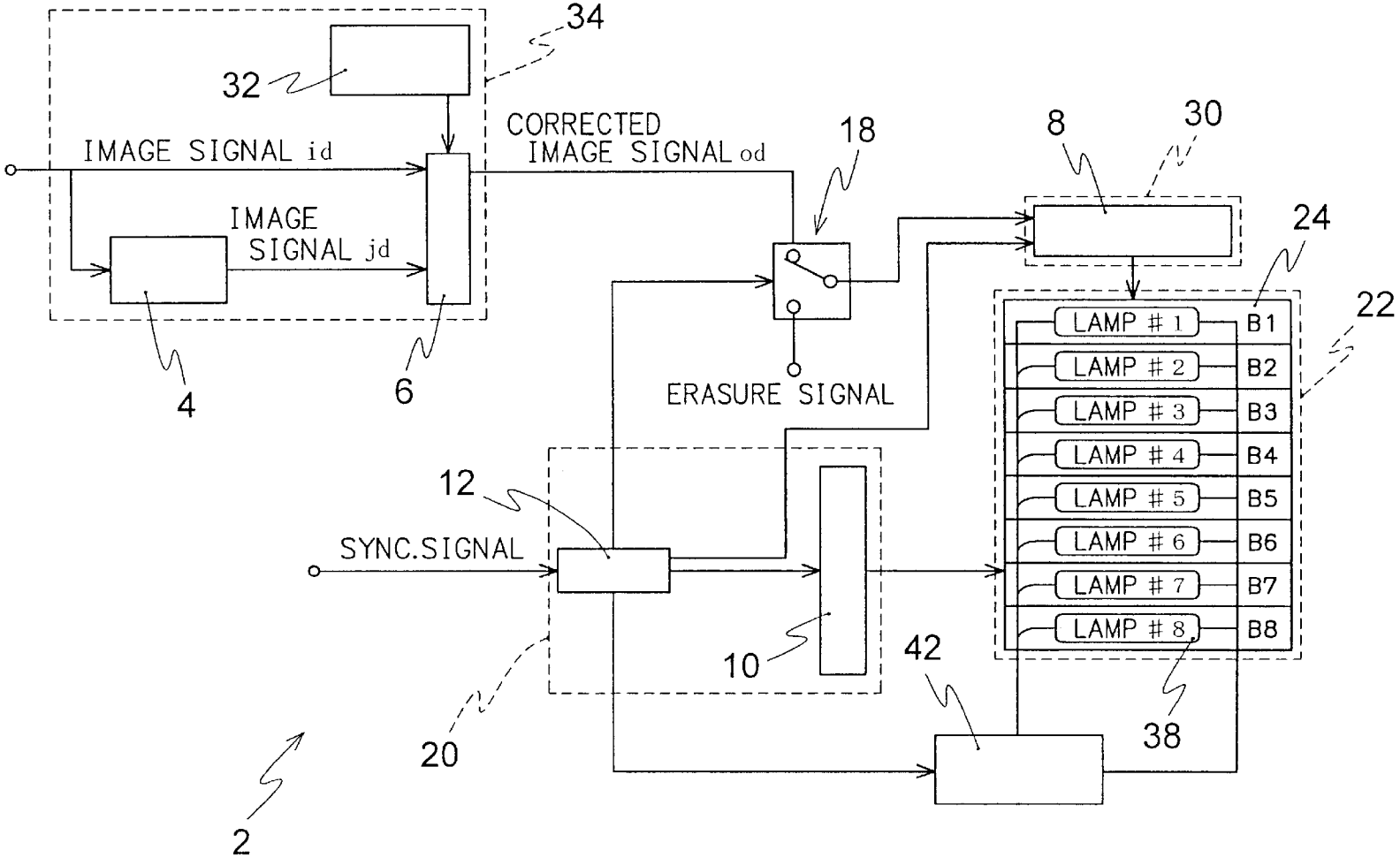
FIG. 15 is a block diagram showing a liquid crystal display device according to the present invention.

FIG. 15 is a block diagram showing a liquid crystal display device according to the present embodiment. The liquid crystal display device 2 according to the present embodiment comprises a signal election circuit 18 to which an erasure signal and an image signal from the image signal processing circuit 34 are input to output either of the two signals to the source driver 8. An erasure signal may be, for example, a black display signal having a voltage level higher than the maximum voltage level of the image signal, that is, an erasure signal may have larger voltage than ordinary black image signal. Generally, the response speed of the TN type liquid crystal is fast when a high voltage is applied. Consequently, when set as a black display signal having a high voltage level, the erasure signal is favorable for the erasure of the previous image. Furthermore, there is an advantage in that a deterioration of the contrast is suppressed when the state in the application of the previous voltage is on a black level.

As has been described above, the liquid crystal display device 2 displays an interlaced type image signal supplied from the outside. In the interlaced type image signal, one frame is configured of two fields, an even number field and an odd number field. The image signal for even number field includes image information to be written into the pixel of the even number rows. The image signal for the odd number field includes image information to be written into the pixel of the odd number rows. Consequently, in the case where the interlaced type image signal is displayed with a general liquid crystal display device, an interlaced scanning is conducted in which only the even number rows are scanned in the even number field and only the odd number rows are scanned in the odd number field.

However, the liquid crystal display device according to the present embodiment subsequently conducts scanning for scanning all the rows in any of the odd field and the even field, and applies the image signal and the erasure signal alternately to each of the rows. The alternate writing of the image signal and the erasure signal can be conducted by changing over alternately the image signal and the erasure signal by the signal election circuit 18.

Figure 16:
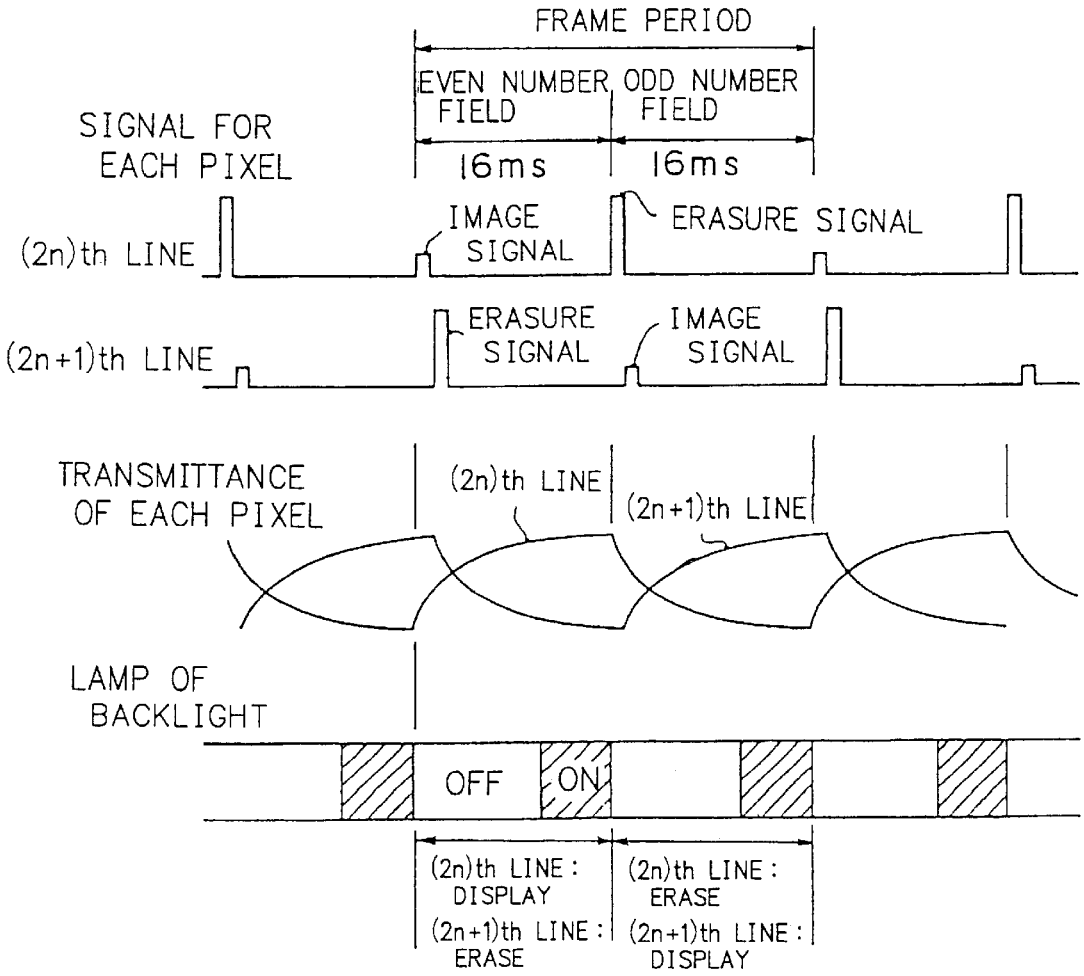
FIG. 16 is a view showing a relation between the application of an erasure signal and transmittance of the liquid crystal in the liquid crystal device according to the present invention.

FIG. 16 is a timing chart showing an operation of the liquid crystal display device 2 according to the present embodiment. As shown in FIG. 16 above, the image signal is written when the even number (=2n) line is selected while the erasure signal is written when the odd number (=2n+1) line is selected, in the even number field. Furthermore, in the odd number field, the image signal is written when the odd number line is selected while the erasure signal is written when the even number line is selected.

Thus, the transmittance of the liquid crystal will be as shown in FIG. 16 middle, by writing the image signal and the erasure signal alternately. The transmittance of the liquid crystal of the even number line, i.e. 2n-th row, changes toward the gradation of the image signal written in the even number field, and subsequently, the image signal written in the even number field is erased to provide a black display at the odd number field. This operation is repeated alternately for each frame. On the other hand, the transmittance of the liquid crystal of the odd number line, i.e. (2n+1)-th row, changes on the contrary to the above even number line, such that the previous image signal is erased to provide a black display at the even number field, and the gradation changes in accordance with the image signal written in the odd number field.

In this manner, before writing the image signal, the displayed image of previous field is erased to provide a uniform black display with the result that the optical response of each pixel can be uniformed irrespective of the display image of the previous frame. For example, even in the case where the pixel providing the black display in the previous frame and the pixel providing the white display in the previous frame are rewritten to a different gray gradation level at the same time, the next gradation signal of gray is written after all the pixels temporarily provides a black display. Thus, virtually no difference in luminance is generated, since there is no difference among the response of the liquid crystal. Consequently, the "ghost" can be removed.

In Embodiment 11, the erasure signal is written by changing over the image signal and the erasure signal for each rows with the signal election circuit 18. However, the method for writing the erasure signal is not limited thereto. For example, by processing an image signal with an appropriate program or by accumulating image signals into memory for several frames in order to provide a series signal in which the image signal and the erasure signal are sequentially arranged, the series signal including the erasure signal can be supplied to the source driver to be applied to the liquid crystal.

Furthermore, in order to suppress the "ghost" and the "motion blur" all together, the backlight may be lighted after the lapse of a definite delay time from the writing of the image signal in each field in a similar manner as Embodiment 8.

As shown in FIG. 15, the display area 24 of the display panel 22 is divided into, for example, eight horizontal stripe-like display blocks B1 through B8 in a row direction and the lamp 38 is arranged for each display block. The lamp 38 is subsequently lighted with the backlight lighting circuit 42 in accordance with the timing signal from the control circuit 12. Then, the lamp of each display block waits for the lapse of the predetermined delay period after the completion of the scanning of the display block to be lighted.

Consequently, the turning on timing of the backlight is as shown in the lower stage of FIG. 16. Since the light is lighted after the liquid crystal sufficiently completes the optical response, the transition state of the transmittance of the liquid crystal is not observed by observers. Furthermore, as a consequence of the limitation of the lamp lighting period of the backlight to short time, the display panel 22 provides an impulse type emission state, so that a sharp image free from the motion blur can be obtained.

In this manner, with the application of the erasure signal and the divided lighting of the backlight, the potential of all the pixels in the display panel is adjusted to the potential of the erasure signal before writing respective image signal. After writing the image signal, the backlight is lit only in the period in which the response of the liquid crystal is stabilized to some extent so that the "ghost" is removed. Furthermore, as a consequence of the limitation of the lighting period of the backlight, the display panel 22 provides an impulse type light emission, so that a sharp image free from the motion blur can be obtained.

Incidentally, an object of the erasure signal is to adjust the transmittance of each pixel to the same level, a white gradation level, a black gradation level or intermediate gradation level will do. However, from the viewpoint of the removal of the "ghost", preferably the erasure signal is a black gradation level. Preferably, the voltage Vh thereof is higher as much as possible. In the case of TN type liquid crystal display device used in normally white mode, the response speed of the liquid crystal is faster in the change from the white gradation level to the black gradation level than in the opposite change. Furthermore, the response speed becomes higher with an increase in the higher voltage applied to the liquid crystal display device. Then, the state of the liquid crystal is stabilized faster at the time of writing the erasure signal with an increase in the response speed of the liquid crystal. Consequently, preferably, the erasure signal is a black gradation level signal and the voltage Vh of this black erasure signal is higher as much as possible. Furthermore, as countermeasures against the "image baking" caused by the impurity in the liquid crystal, preferably, the polarity of the erasure signal applied to each pixel is reversed for each display region or for each frame.

Figure 17:
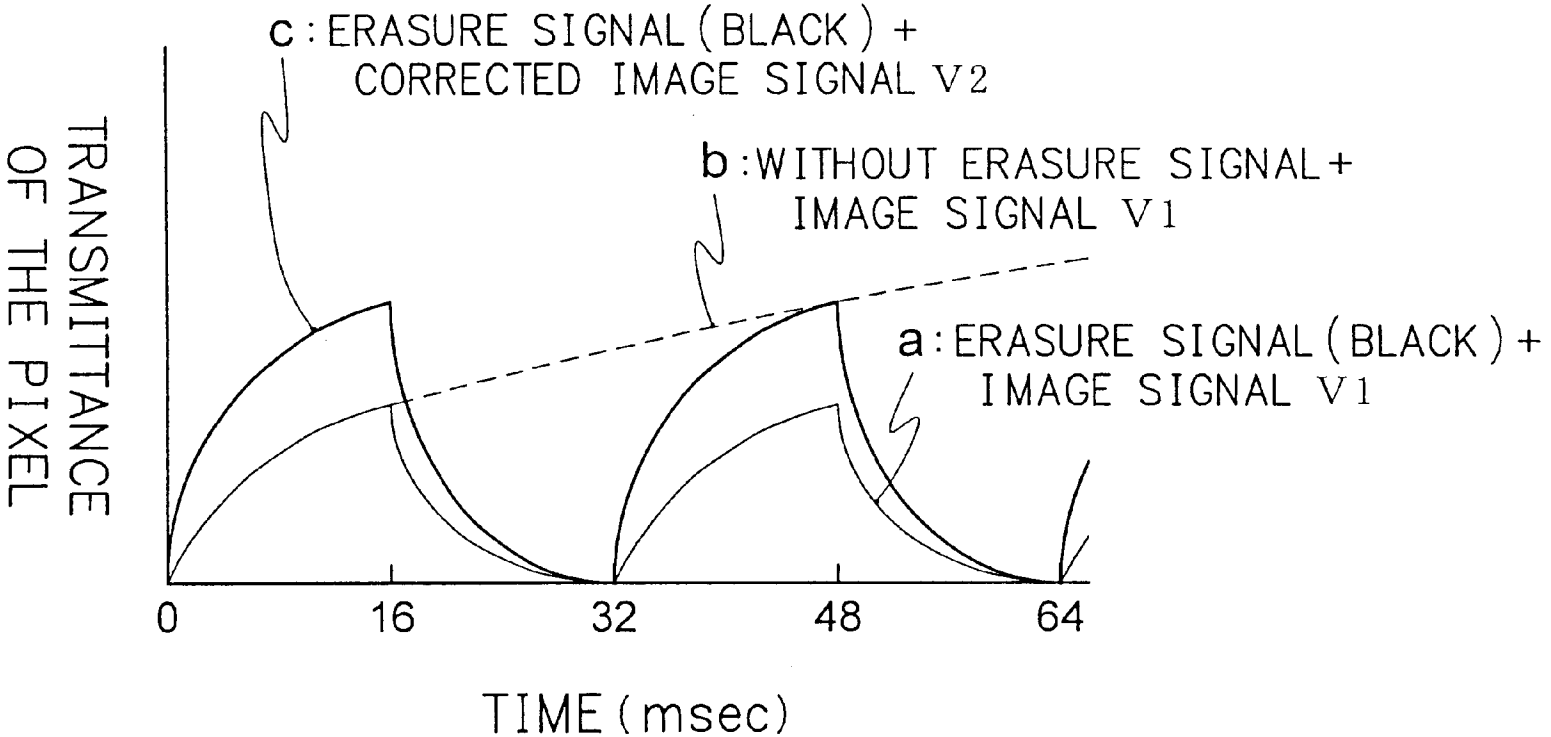
FIG. 17 is a view showing a change in the transmittance of the liquid crystal in the case where the normal voltage is applied after writing the erasure signal and in the case where the corrected voltage is applied.

Furthermore, in the case where the image signal is applied after the application of the black gradation signal Vh as an erasure signal, as shown by a curved line a of FIG. 17, when the applied voltage is determined from the gradation like the prior art, the response speed of the liquid crystal is delayed so that a desired panel transmittance cannot be attained and the luminance of the screen is deteriorated.

Figure 18:
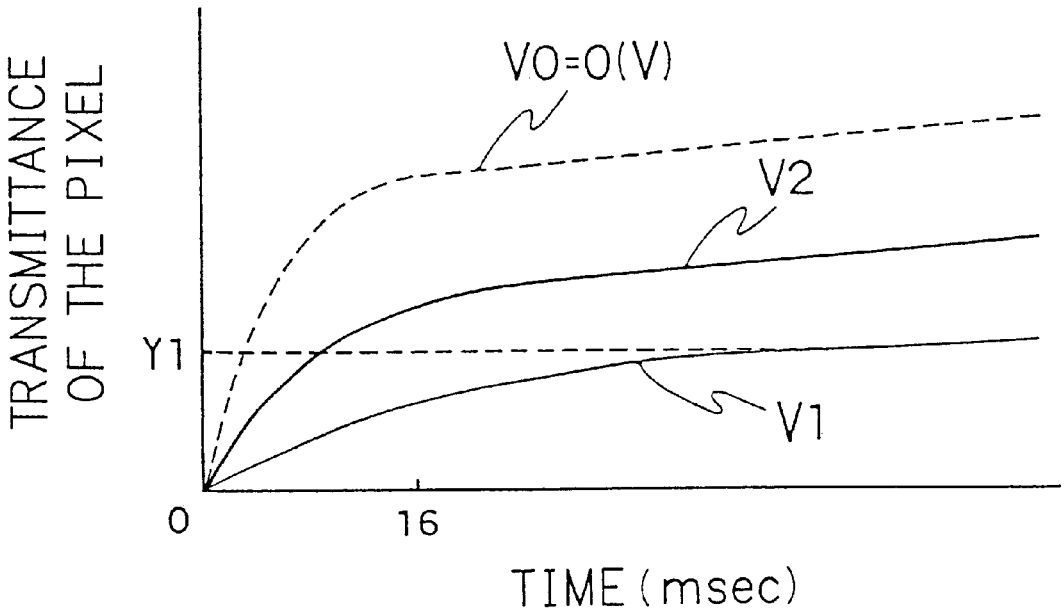
FIG. 18 is a view showing a relation between the applied voltage and the change in the light transmittance of the liquid crystal.

As shown in FIG. 18, time for several frame periods is required in order that the expected transmittance Y1 is attained at the applied voltage corresponding to the original image signal. However, when the correction voltage V2 is applied which is corrected so that a difference with the erasure signal Vh becomes larger, a desired transmittance Y1 is attained within one frame period of 16 msec. Consequently, in the case where the "ghost" is erased by erasing the whole screen by the writing of the black gradation erasure signal, the panel luminance is improved when the correction voltage V2 which attains the desired luminance rate Y1 from the transmittance of the liquid crystal after 16 msec from the black state is selected instead of the voltage V1 which attains the transmittance Y1 in the state of the static image.

As shown in FIG. 18, the characteristic of the liquid crystal is such that the response of the liquid crystal becomes faster when a larger voltage change is applied. For example, the image signal is corrected so that the voltage V2 is provided which attains the transmittance Y1 of the stable state at the time of the application of the image signal V1 at 16 msec, for example, instead of the image signal V1 of FIG. 18. The response of the liquid crystal is accelerated as shown by a curved line c of FIG. 17 by applying the correction voltage V2 after the writing of the black gradation signal with the result that the screen luminance can be improved.

In order to apply the correction voltage V2 to the display panel, the image signal may be corrected by using the signal correction table to be input to the source driver 8 as shown in FIG. 3. In FIG. 3, at the time of determining the voltage av applied to the display panel 22 from the input image signal id, the image signal is corrected so that a correction voltage V2 is applied instead of the voltage V1 of FIG. 18, so that the source driver 8 distributes the voltage to the liquid crystal panel 22 on the basis of the image signal od after correction. As a consequence, the voltage applied to the liquid crystal panel 22 in correspondence to the input image signal can be corrected from V1 of FIG. 18 to V2 without changing a structure of a gradation level voltage generating circuit incorporated in the source driver 8 of the liquid crystal display device 2. Furthermore, the application and non-application of the signal conversion table, namely the practice and non-practice of the signal correction can be changed over with a election signal from the outside by correcting the image signal in this manner.

Figure 19:
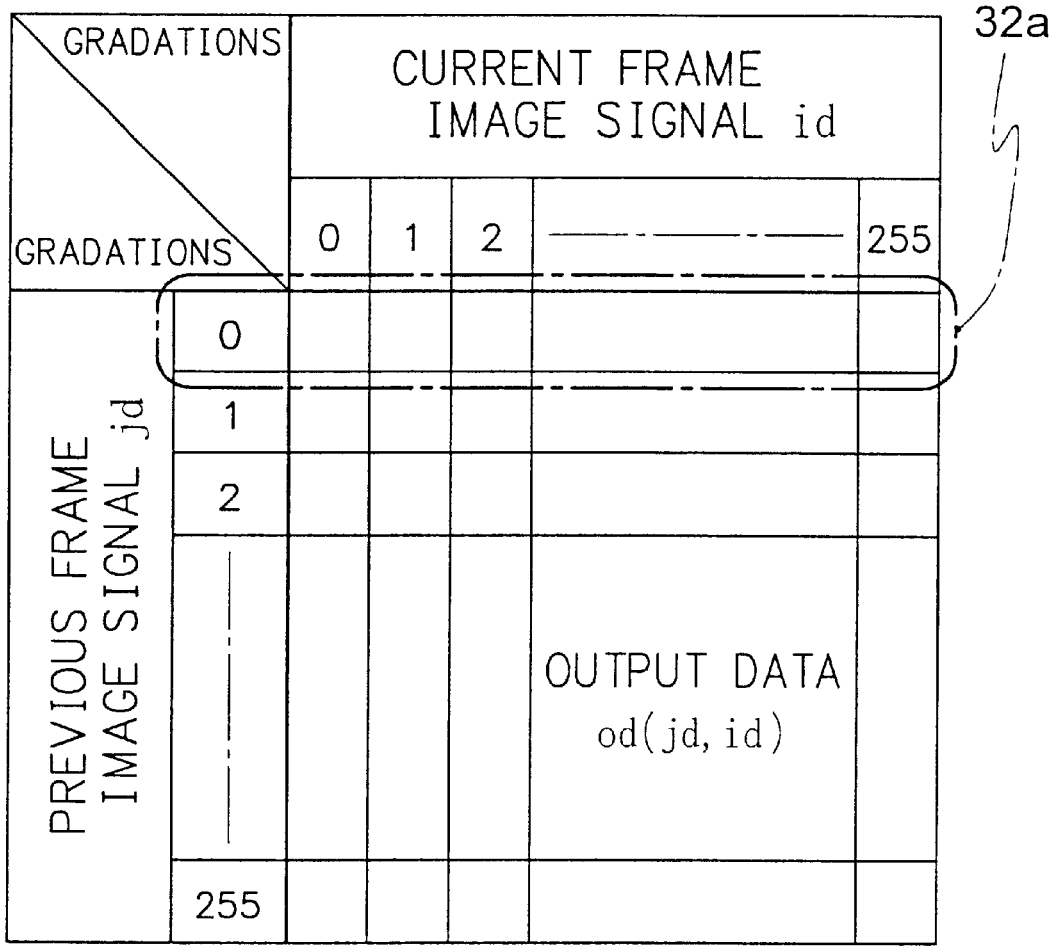
FIG. 19 is a view showing an example of a signal conversion table in the liquid crystal display device according to the present invention.
Figure 20A:
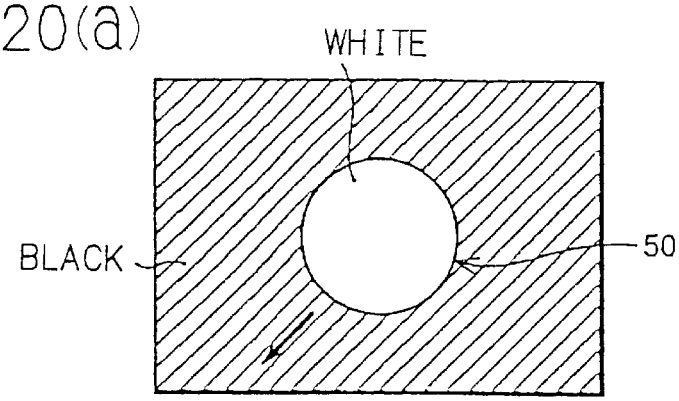
FIG. 20 is a diagram for explaining the deterioration of the display quality in the moving picture display.
Figure 20B:
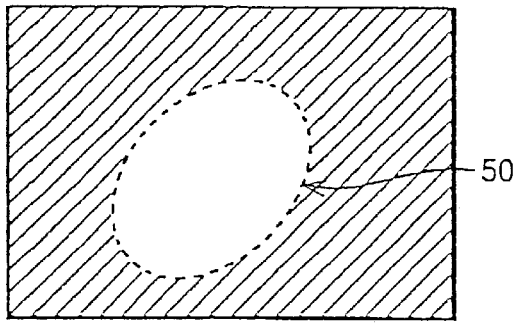
Figure 20C:
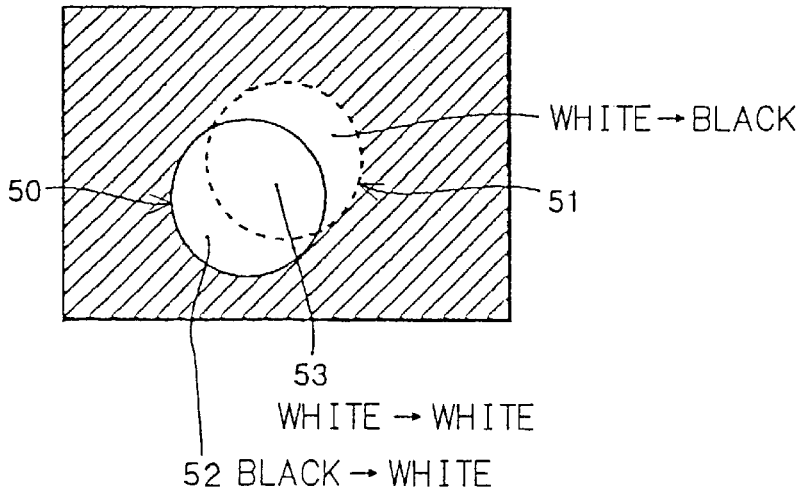
Figure 21:
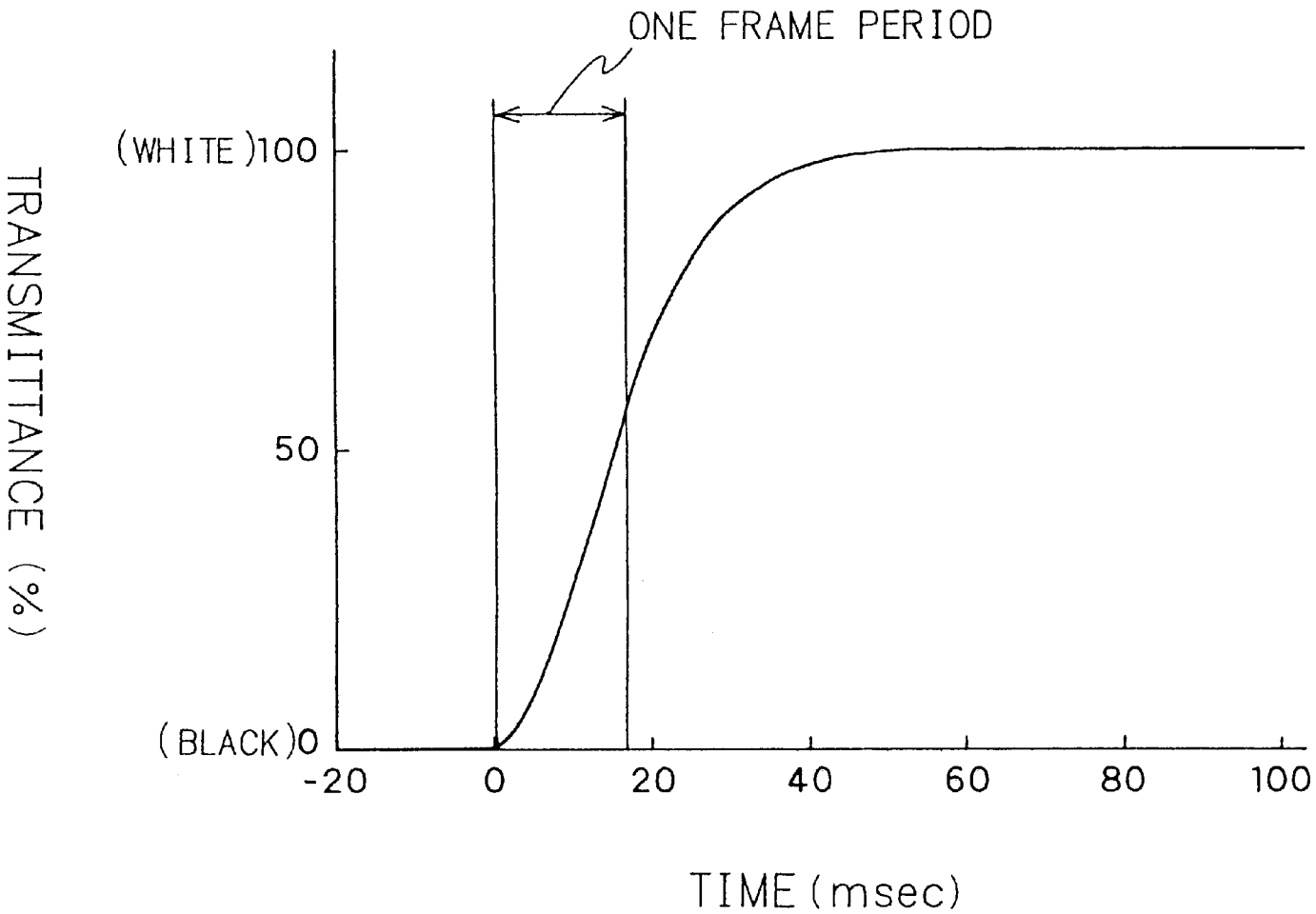
FIG. 21 is a view for explaining a relation between the voltage application and the response of the liquid crystal.
Figure 22A:
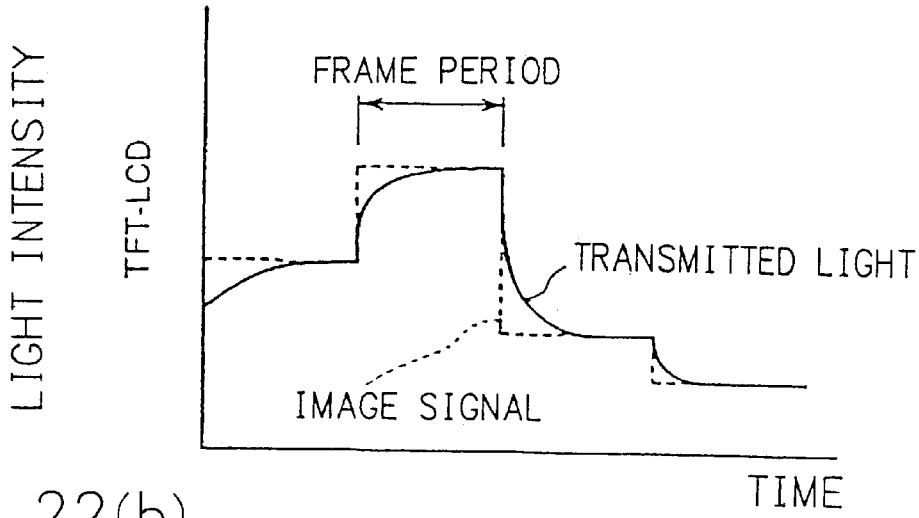
FIG. 22 is a view for explaining a difference between the light emission of a TFT-type liquid crystal display device and the light emission of a CRT.
Figure 22B:
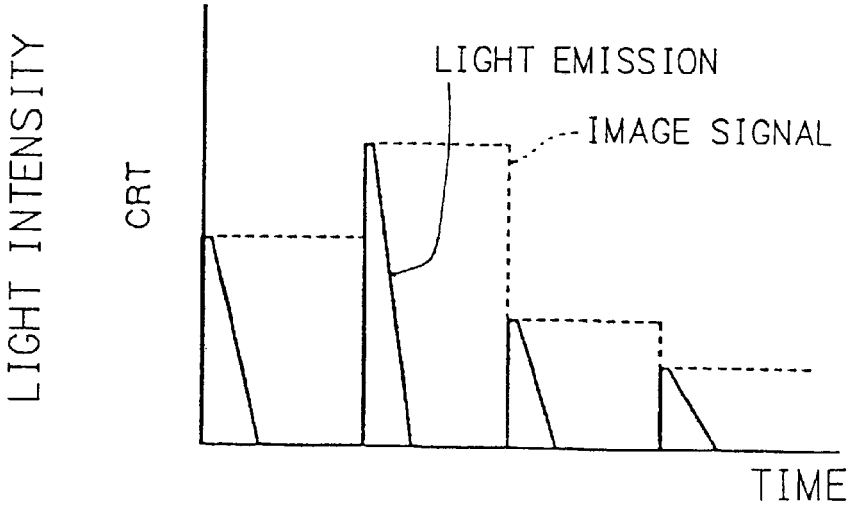
Figure 23:
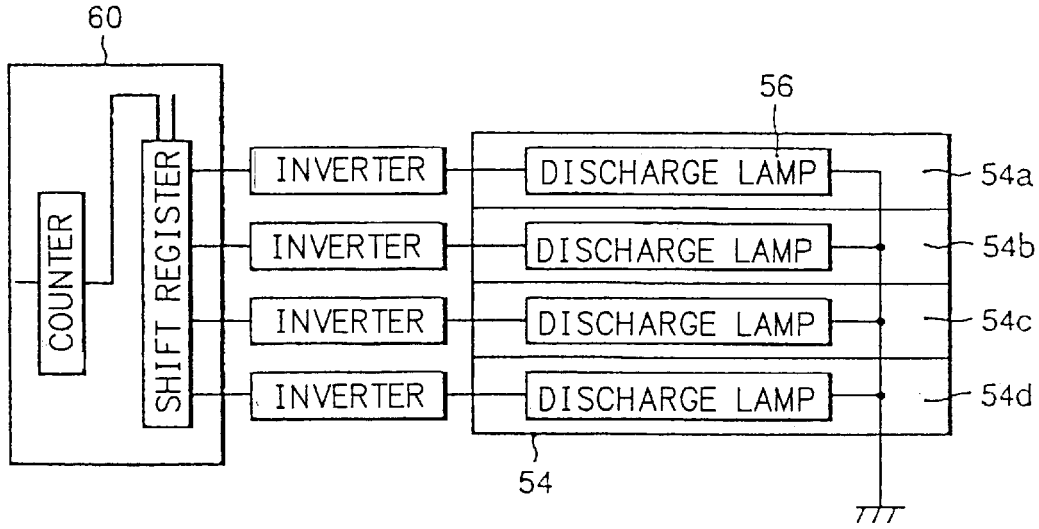
FIG. 23 is a schematic view showing a structure of a conventional liquid crystal display device.
Figure 24:
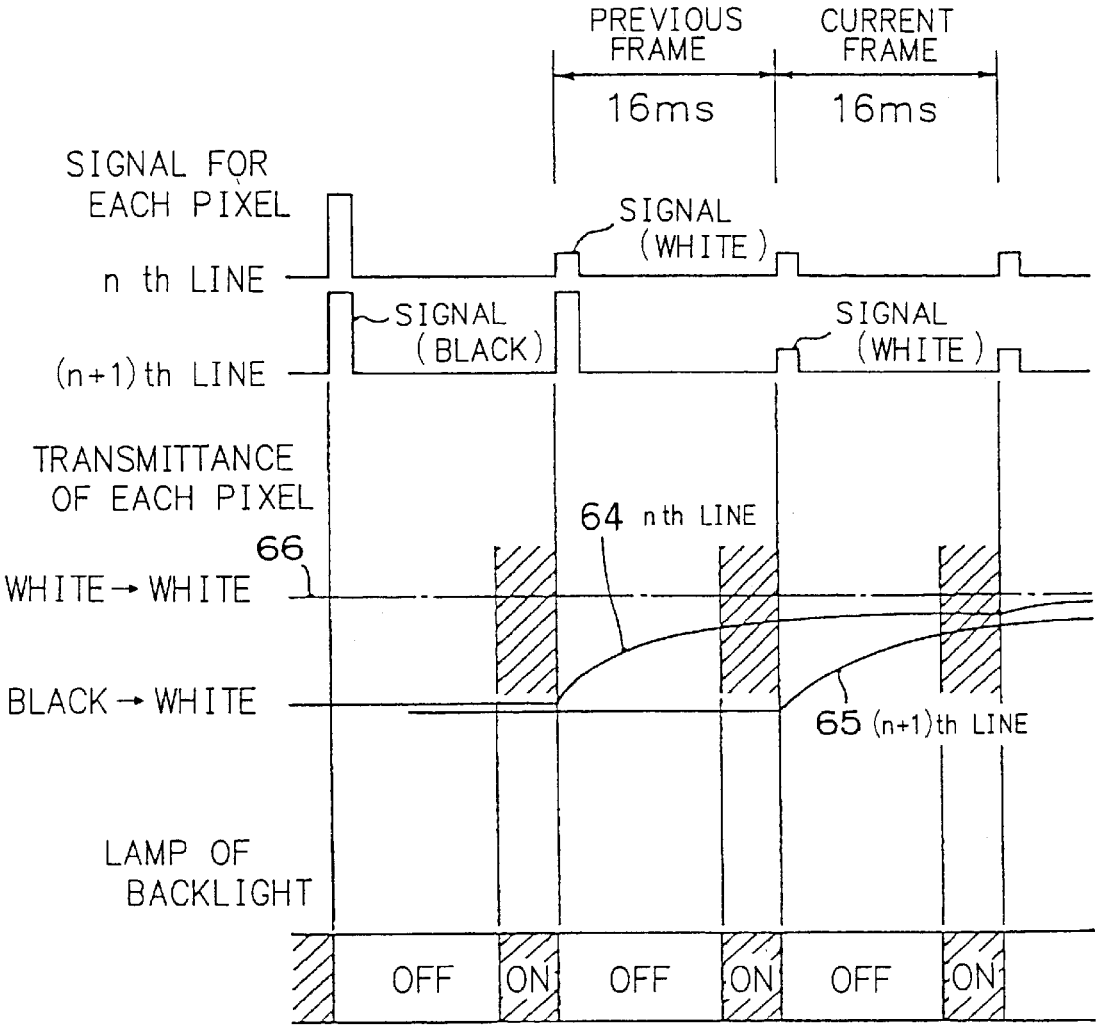
FIG. 24 is a timing chart showing a relation between an transmittance of the liquid crystal and the lighting timing of the backlight.

FIG. 19 is a view showing an example of a signal conversion table. In Embodiment 11, the image signal of the previous field is always black, namely, the gradation is "0". Thus, in the signal conversion table 32*a*, only one row corresponding to the gradation "0" of the previous frame image signal may be extracted and used out of the signal conversion table shown in FIG. 5 or FIG. 6. Furthermore, FIG. 15 shows a frame memory 4. However, in the case of the application of the erasure signal, since the image signal of the previous field is an erasure signal and is always constant, the frame memory 4 can be omitted.

Incidentally, with respect to the interlaced type liquid crystal display method, the liquid crystal display device according to Embodiment 11 for applying an erasure signal to the pixel of the line which is originally non-selected can be easily realized by adding to the conventional progressive driving liquid crystal display device a source of the erasure signal and a signal election circuit for changing over the erasure signal and the image signal. Furthermore, on the contrary, the progressive driving is artificially conducted by using the circuit structure similar to the liquid crystal display device for conducting an interlaced driving, setting the cycle of the start pulse given to the shift register to be a half and shifting the timing of the start pulse of the even line scanning and the odd line scanning by one line while applying the image signal and the erasure signal alternately. Furthermore, the liquid crystal display device providing a divided lighting of the backlight can be easily realized by appropriately setting the number of the lamps in the conventional liquid crystal display device, and providing a backlight lighting circuit which can turn off individually these lamps.

As apparent from the above embodiments, according to the present invention, a liquid crystal display device can be provided in which a display quality of a moving picture is favorable which is free from a residual image of the display object and a contour blur because an optical response of the liquid crystal is heightened in speed while an impulse-like display is provided which has a short light emission for an observer by illuminating the display panel by subsequently turning on and off while setting a voltage applied in the current frame to a voltage at which the liquid crystal comes to have a desired transmittance after one frame period, and furthermore, allowing the light emission partitioned into a plurality of light emission region with respect to the vertical scanning direction to hold a definite time delay in synchronization with the vertical scanning direction of the liquid crystal display portion.

Besides, according to the present invention, since the temperature of the liquid crystal is detected, and a voltage applied to the liquid crystal at the current frame in consideration of the detected temperature is determined, a voltage can be applied at which the liquid crystal comes to have a desired transmittance after one frame period at all times irrespective of the peripheral temperature and the heating state of the backlight. Furthermore, a liquid crystal display device can be obtained wherein a display quality of a moving picture is favorable which is free from a residual image of the display object and a contour blur because an optical response of the liquid crystal is heightened in speed while an impulse-like display is provided which has a short light emission for an observer by illuminating the display panel by subsequently turning on and off while setting a voltage applied in the current frame to a voltage at which the liquid crystal comes to have a desired transmittance after one frame period, and furthermore, allowing the light emission partitioned into a plurality of light emission region with respect to the vertical scanning direction to hold a definite time delay in synchronization with the vertical scanning direction of the liquid crystal display portion.

Furthermore, according to the present invention, a liquid crystal display device can be obtained wherein a voltage can be applied which voltage the liquid crystal comes to have a desired liquid crystal after one frame period and the display quality of a moving picture is favorable by using a signal conversion table in which the transmittance of the previous frame and a transmittance desired in the current frame are set as a row and a column respectively, and a voltage applied to the liquid crystal at the crossing point of the row and the column is arranged.

Furthermore, according to the present invention, a liquid crystal display device can be obtained wherein a parameter memory for memorizing a signal conversion table and a data line for connecting the parameter memory and the processor can be eliminated, the circuit scale is small and cheap, and a display performance of the moving picture is excellent.

Furthermore, according to the present invention, a liquid crystal display device can be obtained wherein the frame memory for memorizing the previous frame image signal and a data line for connecting the processor and the frame memory can be eliminated, a circuit scale is small and cheap and a display performance of the moving picture is excellent.

Besides, according to the present invention, a liquid crystal display device can be obtained wherein interpolation differential data stored in the signal conversion interpolation table is used to determine output data from the current frame, so that a calculation amount can be reduced to decrease the circuit scale while having an excellent display performance of a moving picture.

Besides, according to the present invention, a drive circuit of a liquid crystal display device can be obtained wherein a calculation amount for conducting interpolation can be decreased by equalizing a bit length of the previous frame image signal with the bit length of the previous frame image signal of the signal conversion table, the circuit is small in scale and cheap, and the display performance of the moving picture is excellent.

Furthermore, the liquid crystal display device according to the present invention is characterized in that an image signal is written on one field while an erasure signal is written for adjusting the potential of the pixel to a definite potential in the other field in the display of the interlaced type image signal, so that the optical response time of each pixel is uniformed irrespective of the display image in the previous frame and the "ghost" can be removed.

Furthermore, there is provided a function of correcting a level of an original signal in a direction in which a level difference from the level of the erasure signal becomes large, and this corrected signal is used for the display with the result that the response speed of the liquid crystal is accelerated and the luminance of the liquid crystal panel is improved.

Furthermore, the erasure signal can be written without adding a large change in the circuit structure of the conventional liquid crystal display device of the active matrix type by alternately outputting the erasure signal and the interlaced type image signal for each line while conducting a general progressive driving.

Besides, the erasure signal is written by connecting the horizontal driving circuit to the image signal supply source and the erasure signal supply source in a switchable manner and alternately switching the connection to the image signal supply source and the erasure signal supply source for each line. Thus, the erasure signal is written with a simple circuit structure.

Furthermore, the removal effect of the "ghost" can be further heightened by setting the erasure signal to a black gradation level signal to fast stabilize the state of the liquid crystal at the time of writing the erasure signal.

Furthermore, when the erasure signal is set as an intermediate signal, the deterioration in the luminance of the screen can be prevented which results from the writing of the erasure signal by setting the luminance of the line which is being erased as an average luminance of the screen.

Furthermore, a light source is provided which can illuminate the display panel by dividing the display panel into a plurality of display regions with the result that the "ghost" can be further effectively removed, and the motion blur can be prevented together with it.

Furthermore, a divided illumination can be conducted with a similar structure as the conventional liquid crystal display device by using a light source having a plurality of lamps which can be lighted by dividing light for each of the display regions.

Furthermore, an operation of the light source can be heightened than by subsequently turning on and off lamps by using a light source provided with a shutter which can be divided for each display region and can be opened and closed.

The foregoing is considered as illustrative only of the principles of the invention. Further, because numerous modifications and change will readily occur to those skilled in the art, it is not desired to limit the invention to the exact construction and operation shown and described, and accordingly all suitable modifications and equivalents may be resorted to falling within the scope of the invention as defined by the claims which follow.

What is claimed is:

1. A liquid crystal display device comprising:

display panel having pixels arranged in a matrix-like row and column configuration in a display area and switching means connected to each of the pixels, a vertical driving circuit for scanning the display area of the display panel in one frame period by selecting the rows of pixels alternately while turning on the switching means connected to the pixels of the rows of pixels, and horizontal driving means for applying a voltage, which corresponds to an image signal, to each pixel in the row selected by turning on the switching means, signal correcting means for generating a corrected image signal using a transmittance of a previous frame to determine a voltage level necessary for attaining a desired transmittance in a current frame, within one frame period, and for providing the corrected image signal to the horizontal driving means, and an illumination device having a plurality of light emitting regions for illuminating the display panel, the light emitting regions sequentially turning on and off in synchronization with selection of the rows of each light emitting region, while maintaining a definite time delay in the selection of rows.

2. The liquid crystal display device of claim 1 comprising election means for selectively providing one of the corrected image signal and an erasure signal to the horizontal driving means, wherein the corrected image signals are provided for the pixels in even numbered rows while the erasure signal is provided for the pixels in odd numbered rows during even numbered frames, and the erasure signal is provided for the pixels in the even numbered rows while the corrected image signals are provided for the pixels in the odd numbered rows during odd numbered frames.

3. The liquid crystal display device of claim 1 comprising temperature detecting means for detecting temperature of a liquid crystal material in the display panel, wherein the signal correcting means corrects the level of an image signal using temperature detected as a parameter.

4. The liquid crystal display device of claim 1 comprising:

temperature detecting means for detecting temperature of a liquid crystal material in the display panel, and election means selectively providing one of the corrected image signal and an erasure signal to the horizontal driving means, wherein the signal correcting means corrects the level of an image signal using the temperature detected as a parameter, and the corrected image signals are provided for the pixels in even numbered rows while the erasure signal is provided for the pixels in odd numbered rows during even numbered frames, and the erasure signal is provided for the pixels in the even numbered rows while the corrected image signals are provided for the pixels in the odd numbered rows during odd numbered frames.

5. The liquid crystal display device of claim 1, in which currents flowing through respective lamps in the light emitting regions are independently controlled.

6. The liquid crystal display device of claim 1, in which turn on periods of each of the light emitting regions are independently controlled.

7. The liquid crystal display device of claim 1, in which turn on periods of each of the light emitting regions are divided into turn on and turn off sub-periods.

8. A liquid crystal display device in which an image signal of a current frame is externally input, a voltage, with which transmittance designated by current frame image data is attained within one frame period, is applied to the liquid crystal display device at the current frame, and the voltage applied to the liquid crystal display varies in accordance with temperature of a liquid crystal material of the liquid crystal display, wherein the voltage applied to the liquid crystal material during the current frame is determined depending on the current frame image data and previous frame image data.

9. The liquid crystal display of claim 8 comprising:

a temperature detection circuit for detecting the temperature of the liquid crystal material, a frame memory for storing a present frame image signal for a definite time to output a previous frame image signal, a plurality of signal conversion tables in which output data is stored in correspondence with each value of the previous frame image signal and each value of the current frame image signal, and a processor for determining the output data from the current frame image signal and the previous frame image signal by using one of the signal conversion tables selected based on the temperature detected by the temperature detection circuit.

10. The liquid crystal display of claim 9 wherein the output data in the signal conversion table is determined so that a transmittance designated by the current frame image signal is attained within one frame period by applying a voltage determined by the output data.

11. The liquid crystal display of claim 8 comprising:

a temperature detection circuit for detecting the temperature of the liquid crystal material, a frame memory for storing a present frame image signal for a definite time to output a previous frame image signal, a plurality of signal conversion tables in which output data is stored in correspondence to a part of each value of the previous frame image signal and a part of each value of the current frame image signal, and a processor for determining the output data from the current frame image signal and the previous frame image signal by using one of the signal conversion tables selected based on the temperature detected by the temperature detection circuit.

12. The liquid crystal display of claim 11 wherein the frame memory stores a present frame image signal having a bit length converted for a definite time and outputs a previous frame image signal.

13. The liquid crystal display of claim 12 wherein a number of gradations, represented by a previous frame image signal having a bit length converted, is equal to a number of gradations of the previous frame image signal in the signal conversion table.

14. The liquid crystal display of claim 11 comprising a signal conversion interpolation table in which interpolation differential data is stored in correspondence to part of each value of the previous frame image signal and part of each value of the current frame image signal, wherein the processor determines output data using the signal conversion interpolation table as well as the signal conversion table selected based on the temperature detected.

15. The liquid crystal display of claim 14 wherein the frame memory stores a present frame image signal having bit length converted for a definite time and outputs a previous frame image signal.

16. A liquid crystal display device comprising:

converting means for converting bit length of current frame image signal, a frame memory for storing a present frame image signal, having bit length converted, for a definite time, to output a previous frame image signal, a signal conversion table in which output data is stored in correspondence to each value of the previous frame image signal and part of each value of the current frame image signal, a processor for determining the output data from the current frame image signal and the previous frame image signal using the signal conversion table, and an illumination device for illuminating a display area of the liquid crystal display and including a plurality of horizontal stripe light emitting regions.

17. The liquid crystal display of claim 16 further comprising:

temperature detection circuit for detecting temperature of a liquid crystal material of the liquid crystal display, and a plurality of signal conversion tables in which output data is stored in correspondence to each value of the previous frame image signal and part of each value of the current frame image signal, wherein the processor determines the output data using one of the signal conversion tables selected based on the temperature detected by the temperature detection circuit.

18. A liquid crystal display device of an active matrix type wherein an interlaced image signal comprising even numbered fields and odd numbered fields is displayed, an original image signal designating a image to be displayed is corrected to enlarge a level difference between the original image signal and an erasure signal, and corrected image signals are provided for pixels in even numbered rows while an erasure signal is provided for pixels in odd numbered rows during even numbered fields, and the erasure signal is provided for the pixels in the even numbered rows while corrected image signals are provided for the pixels in the odd numbered rows during odd numbered fields.

19. The liquid crystal display device of claim 18 comprising an illumination device for illuminating the display area of the liquid crystal display with a plurality of horizontal stripe light emitting regions, wherein each light emitting region turns on only for a period which is delayed from completion of the selection of rows in each light emitting region, and the level of original image signal is corrected to a level with which transmittance in a steady state of the pixel with the original image signal is attained within one field.

* * * * *